US009055795B2

(12) United States Patent
Larkin

(10) Patent No.: US 9,055,795 B2
(45) Date of Patent: Jun. 16, 2015

(54) CABLE TETHERING NECKPIECE

(71) Applicant: Nicholas Stuart Larkin, Lancaster, KY (US)

(72) Inventor: Nicholas Stuart Larkin, Lancaster, KY (US)

(73) Assignee: Nicholas Stuart Larkin, Lancaster, KY (US)

( * ) Notice: Subject to any disclaimer, the term of this patent is extended or adjusted under 35 U.S.C. 154(b) by 0 days.

(21) Appl. No.: 13/852,763

(22) Filed: Mar. 28, 2013

(65) Prior Publication Data

US 2013/0256345 A1 Oct. 3, 2013

Related U.S. Application Data

(60) Provisional application No. 61/685,986, filed on Mar. 29, 2012.

(51) Int. Cl.

| | |
|---|---|
| ***A45C 11/00*** | (2006.01) |
| *H04R 1/10* | (2006.01) |
| *H04R 5/033* | (2006.01) |

(52) U.S. Cl.

CPC ..... *A45C 11/00* (2013.01); *A45C 2011/001* (2013.01); *A45F 2200/0516* (2013.01); *H04R 1/1033* (2013.01); *H04R 1/1041* (2013.01); *H04R 1/105* (2013.01); *H04R 5/0335* (2013.01); *H04R 2201/103* (2013.01); *H04R 2201/107* (2013.01); *H04R 2420/09* (2013.01)

(58) Field of Classification Search

CPC ..... H04R 5/0335; H04R 1/1066; H04M 1/05; A45F 2200/0516; A45C 2011/001

USPC ..... 224/201, 181, 189, 251, 265, 930; 181/129; 381/364, 309; D28/41; 2/DIG. 11

See application file for complete search history.

(56) References Cited

U.S. PATENT DOCUMENTS

| | | | | |
|---|---|---|---|---|
| 893,998 | A * | 7/1908 | Harris | 359/880 |
| 1,871,066 | A * | 8/1932 | Lubell | 2/309 |
| 2,460,458 | A * | 2/1949 | Kobrin | 379/449 |

(Continued)

FOREIGN PATENT DOCUMENTS

| | | | |
|---|---|---|---|
| JP | 2001137035 | A | 5/2001 |
| JP | 2001197919 | A | 7/2001 |
| WO | 2007039281 | A1 | 4/2007 |

OTHER PUBLICATIONS

PCT Communication dated Jul. 1, 2013 for corresponding international application PCT/2013/034548 filed Mar. 29, 2013.

*Primary Examiner* — J. Gregory Pickett
*Assistant Examiner* — John Cogill
(74) *Attorney, Agent, or Firm* — Quinn Law Group, PLLC.

(57) ABSTRACT

A neckpiece wearable by a user includes opposing arm segments operatively connected to each other and configured such that each arm segment defines a tethering element configured to removably retain a cable to the neckpiece. The arm segments may be arranged to retain the neckpiece to the user's neck intermediate the shoulders and jaw of the user, such that the neckpiece when worn by the user is not in contact with the user's shoulders and/or is not supported in position by the user's shoulders. An access opening allows the user to don and doff the neckpiece, and is preferably less than 35% of the perimeter of the neckpiece. The neckpiece may include a grasping interface to exert a grasping pressure on the user's neck. The neckpiece may include a physiological sensing element. The arm segments may be formed of wire. A connecting element may detachably connect the opposing arm segments.

20 Claims, 10 Drawing Sheets

(56) References Cited

U.S. PATENT DOCUMENTS

| | | | | |
|---|---|---|---|---|
| 3,197,099 | A * | 7/1965 | Doba | 224/148.4 |
| 4,070,553 | A | 1/1978 | Hass | |
| 4,485,276 | A | 11/1984 | Sato | |
| 4,499,593 | A | 2/1985 | Antle | |
| 4,685,448 | A | 8/1987 | Shames et al. | |
| 4,689,822 | A * | 8/1987 | Houng | 381/379 |
| 4,864,619 | A | 9/1989 | Spates | |
| 4,930,148 | A * | 5/1990 | Lee | 455/575.2 |
| 4,993,065 | A | 2/1991 | Chiou | |
| 5,689,822 | A | 11/1997 | Zucker | |
| 5,692,243 | A * | 12/1997 | Chang | 2/171 |
| 5,708,725 | A * | 1/1998 | Ito | 381/370 |
| 5,815,579 | A | 9/1998 | Boyden | |
| 5,835,609 | A | 11/1998 | LeGette et al. | |
| 5,881,390 | A | 3/1999 | Young | |
| 5,946,728 | A * | 9/1999 | Tane | 2/171 |
| 6,047,709 | A * | 4/2000 | Tu | 132/275 |
| 6,178,251 | B1 | 1/2001 | Luchs et al. | |
| D461,932 | S * | 8/2002 | Riva | D28/41 |
| 6,603,863 | B1 | 8/2003 | Nagayoshi | |
| 6,920,228 | B2 | 7/2005 | Redmer et al. | |
| 6,934,567 | B2 | 8/2005 | Gantz et al. | |
| 7,328,710 | B2 * | 2/2008 | Hall et al. | 132/208 |
| 7,428,429 | B2 | 9/2008 | Gantz et al. | |
| 7,570,977 | B2 | 8/2009 | Gantz et al. | |
| 7,643,646 | B2 | 1/2010 | Fielding, Jr. | |
| 7,920,902 | B2 * | 4/2011 | Carroll | 455/569.1 |
| 7,959,489 | B2 * | 6/2011 | Shaffstall | 450/86 |
| 8,009,853 | B2 * | 8/2011 | Ito et al. | 381/381 |
| 8,649,547 | B2 | 2/2014 | Hsu Huang et al. | |
| 8,652,062 | B1 | 2/2014 | Holder | |
| 2002/0173346 | A1 | 11/2002 | Wang | |
| 2003/0012394 | A1 | 1/2003 | Lee | |
| 2003/0059071 | A1 | 3/2003 | Dunham | |
| 2005/0036643 | A1 | 2/2005 | Le Gette et al. | |
| 2006/0126881 | A1 | 6/2006 | Ito et al. | |
| 2006/0210092 | A1 | 9/2006 | Navid | |
| 2007/0021073 | A1 | 1/2007 | Gratton | |
| 2007/0220718 | A1 | 9/2007 | Eldracher | |
| 2007/0277995 | A1 | 12/2007 | Sakai | |
| 2009/0111527 | A1 | 4/2009 | Richardson et al. | |
| 2009/0180658 | A1 | 7/2009 | Dolberg | |
| 2009/0274335 | A1 | 11/2009 | Cheung et al. | |
| 2009/0301510 | A1 * | 12/2009 | Hsu | 132/273 |

* cited by examiner

CABLE TETHERING NECKPIECE

CROSS-REFERENCE TO RELATED APPLICATIONS

This application claims priority to and the benefit of U.S. Provisional Patent Application No. 61/685,986, filed on Mar. 29, 2012, which is hereby incorporated by reference in its entirety.

TECHNICAL FIELD

The present invention relates to a wearable neckpiece for tethering a cable, such as a cable used in conjunction with an electronic device.

BACKGROUND

The development of personal entertainment and communication devices has centered on increased functional capacity, transportability, and ease of use. Technological advancements have allowed miniaturization of components while enhancing device capability. Currently at the forefront of this industry are wired and wireless earpieces that connect to cell phones and digital audio players.

Cables extending from the earpiece to the connected electronic device often cause annoyance to the user through contact with the face and obstruction of vision. This is especially the case in activities involving movement or non-upright postures. When cabled ear-pieces are worn during activities that involve movement, or unusual positioning or orientation of the head, it is common for the wearer to experience 'pull-out' (referring to involuntary removal of the earpiece from the ear), and/or entanglement or annoyance from the earpiece's cables.

The weight and inertia of earpieces and cables, especially when lengthy and unsecured, often causes 'pull-out' when the user is moving, as this motion multiplies the effect of weight. Additionally when the user is in a non-upright position the forces required to cause 'pull-out' are often significantly less due to the design of the earpiece. Furthermore, entanglement in cables may occur in any position, but especially when the user is in a 'head-down' position that allows the cables fall away from the body, or when the user is engaged in any activity with movement close to the body and face.

Devices such as form fitting ear buds, ear-hooks and ear-clips have been used to more securely hold the earpiece in place, but often these devices prove uncomfortable to the user. Wireless ear-worn devices require components such as batteries that significantly contribute to the weight and inertia of the ear-worn device, and often prove uncomfortable to the user. Cable-mounted clips have been used to secure cables to a garment, however this type of attachment still provides a considerable length of unsupported or unsecured cable between the cable-mounted clip and the earpiece.

SUMMARY

A user-worn neckpiece configured as an accessory to an electronic user device such as a personal entertainment and/or communication device is described herein. The neckpiece is worn by the user around the neck to securely hold and position cables which may be connected to the user device, such as earpiece cables. The neckpiece includes tethering elements configured to retain the cables relative to the earpiece, such that the user may engage in vigorous activities or unusual postures without experiencing "pull-out" of the earpieces from the user's ears. The neckpiece is further configured to provide a stable and capacious platform for attaching or containing other components such as batteries, antennas, customized storage, battery charging, or carrying and operation of these personal user devices.

In the examples shown, the neckpiece described herein provides advantages including reducing or preventing annoyance from or entanglement of earpiece cables by tethering these cables to a location very near the user's ear, thereby limiting the length of the cable extending between the neckpiece and the user's ear and minimizing the weight of the length of unsupported cable suspended from the user's ear. The tethering of the earpiece cable to a location on the side of the user's neck prevents overly extension of or entanglement of the cables thereby preventing the annoyance of the user associated therewith. Only a very short length of slack cable, adjustable and/or determined by the user during set-up, is required between the neckpiece and the earpiece to allow full range of movement of the head, neck and shoulders. Positioning the neckpiece mid-neck leaves movement of the head and shoulders unencumbered by the neckpiece.

The earpiece while tethered to the neckpiece via the cable may be easily removed from the ear, as it requires no ear-hooks or clips, and may be allowed to hang loosely from the short length of cable attached to the neckpiece. In this position with a comparatively short length of hanging cable, opportunity for the earpiece and cable to become entangled is minimized or substantially eliminated. The neckpiece supports the weight of the cable and earpiece and maintains the earpiece in convenient proximity to the ear such that the earpiece is easily located by the user and readily reinsertable in the ear when desired.

The neckpiece may be configured to store and/or tether batteries and/or other electrical components including, for example, microphones, speakers, the user device, etc., such that the weight of these is supported by the neckpiece. Other components may be operatively attached to or tethered by the neckpiece, including sensors for monitoring user parameters such as the user's pulse, respiration and/or temperature.

The neckpiece may include opposing arm segments operatively connected to each other and configured such that each arm segment defines a tethering element configured to removably retain a cable to the neckpiece. The arm segments may be arranged to retain the neckpiece to the user's neck in a mid-neck location intermediate the shoulders and jaw of the user, such that the neckpiece when worn by the user is not in contact with the user's shoulders and/or is not supported in position by the user's shoulders. An access opening is defined by ends of the arm segments, and is provided to allow the user to don and doff the neckpiece. In one example, the access opening is configured such that when worn by the user, the access opening is not greater than 35% of the perimeter of the neckpiece inclusive of the access opening, and preferably the access opening is between 20% and 35% of the perimeter of the neckpiece. In another example, the access opening is configured such that when worn by the user, the neckpiece does not impose on the throat portion of the user's neck, such that access opening is sufficiently wide that the width of the access opening corresponds a distance between 15% and 25% of the circumference of the user's neck.

The neckpiece may be configured to provide a grasping interface, which may be defined by the arm segments such that when the neckpiece is worn by the user the grasping interface exerts a grasping pressure on the user's neck. A nape interface intermediate the opposing arm segments may define a substantially flat surface to comfortably interface with the nape portion of the user's neck, and may be configured to cooperate with the grasping interfaces to retain the neckpiece to the user's neck intermediate the user's jaw line and shoulders, such that the neckpiece is not resting on the user's shoulders or interfering with the user's mobility.

The neckpiece may include one or more tethering elements configured to retain a cable, such as a cable for an electronics device or other user device, to the neckpiece. The neckpiece may be configured to define a cable pathway for retaining the cable to the neckpiece. The tethering elements may be repositionable on the neckpiece and/or have a variety of different configurations, and the neckpiece may include features such as channels and apertures, for example, configured to partially define and/or cooperate with the tethering elements to retain the cable to the neckpiece.

Other components may be operatively attached to the neckpiece, including various electronic components and/or sensing elements. In one example, a sensing element configured to sense a physiological parameter of the user may be operatively or selectively attached to the neckpiece and configured such that when the neckpiece is worn by the user, the sensing element interfaces with the user to sense the physiological parameter. The output from the sensing element may be communicated to a monitor, a recorder, a display or an alert, for communication to the user.

In one example, the neckpiece may include a tubular portion at least partially defined by one of the central segment and the arm segments and defining an interior channel configured to receive a cable. The tubular portion may include a plurality of apertures in communication with the interior channel and configured to receive the cable. The interior channel and plurality of apertures may be arranged to define a tethering element for retaining the cable to the neckpiece.

In another example, the neckpiece may comprise opposing arm segments extending from a central segment, wherein each arm segment is formed of wire and includes a tethering element configured to removably retain a cable to the neckpiece. The neckpiece may include a connecting element configured to detachably connect the opposing arm segments, and may further include an orientation feature to orient the opposing arms relative to each other when connected by the connecting element. The wire may be formed into a spiral or helix to define a tethering element and/or to define a cable pathway for retaining a cable to the neckpiece.

The above features and other features and advantages of the present invention are readily apparent from the following detailed description of the best modes for carrying out the invention when taken in connection with the accompanying drawings.

DETAILED DESCRIPTION

Figure 1A:
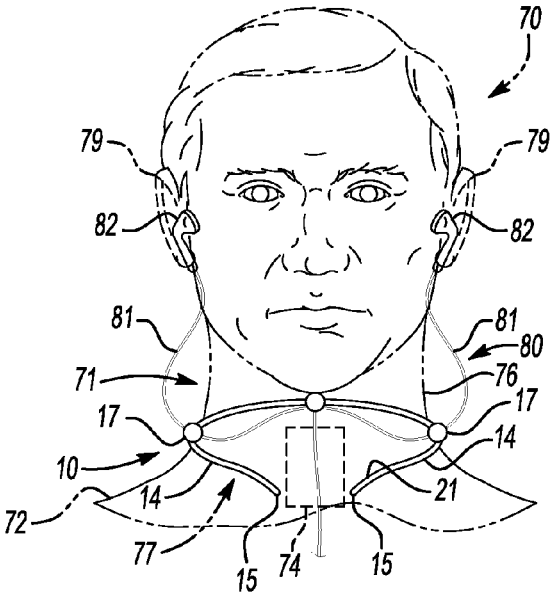
FIG. 1A is a schematic front perspective view of a neckpiece including a plurality of tethering elements configured to retain a cable.
Figure 1B:
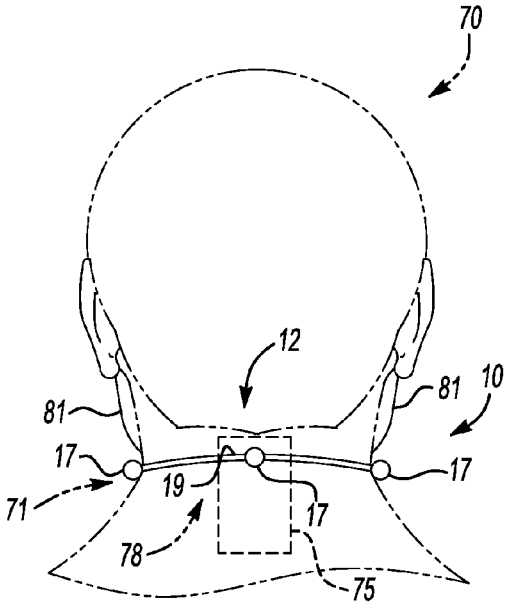
FIG. 1B is a schematic rear view of the neckpiece of FIG. 1A.
Figure 1C:
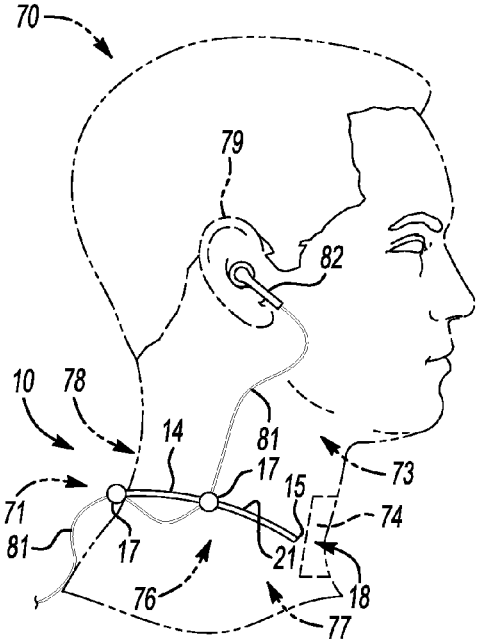
FIG. 1C is a schematic side view of the neckpiece of FIG. 1A.

Referring to the drawings wherein like reference numbers represent like components throughout the several figures. The arrangement of the components in the schematic illustrations included herein is for purposes of disclosure and is not intended to be limiting. The elements shown in FIGS. 1-17 are not to scale or proportion and the particular dimensions and applications provided in the drawings presented herein are not to be considered limiting.

Referring to FIGS. 1A-1D, a neckpiece for tethering a cable is shown generally indicated at 10. The neckpiece 10 is wearable by a user generally indicated at 70 and shown in phantom throughout the figures. Example configurations of neckpieces 10A-10F are described herein as non-limiting illustrative examples, and include neckpiece features and elements, such as tethering elements 17, which may be used with more than one configuration of neckpiece 10, and/or in configurations, combinations, embodiments and arrangements additional to those shown for illustrative purposes in the included figures. The neckpiece 10 includes at least one tethering element generally indicated at 17, where the tethering element 17 is configured to retain a cable 81 to the neckpiece 10. Various configurations of tethering elements 17A-17H are described herein as illustrative examples. It would be understood that these illustrative examples are not intended to be limiting, and that other configurations, combinations and arrangements of tethering elements 17 additional to those shown for illustrative purposes in the included figures are useable to tether a cable 81 to the neckpiece 10. Referring to FIGS. 1A-6B, and for purpose of illustration, the tethering elements 17 are shown generically in these figures as a circular or other simple geometric shape to indicate a tethering element 17 which may be of any suitable configuration functional to tether the cable 81 to the neckpiece 10. Configurations of the tethering elements 17 may include, but not be limited to, tethering elements 17 including hooks, claws, tabs, loops, spirals, eyelets, conduits, fasteners, clips, cleats, tethers, bands, spirals, straps, or the like and/or tethering elements 17 such as apertures, channels, grooves, eyelets, slots, or the like defined by the neckpiece 10 to provide a unitary neckpiece 10, or by attachments or inserts to the neckpiece 10. The tethering element 17 may be configured such that the cable 81 may be removably attached to and/or repositionable relative to the tethering element 17. The tethering element 17 may be configured such that the tethering element 17 is removably attached to and/or repositionable relative to the neckpiece 10.

In the example shown, the cable 81 may be a cable used in conjunction with a user device, or may be a portion of a cable or a cable branch comprising a cable assembly such as the cable assembly generally indicated at 80 in FIG. 1A. The cable assembly 80 may be configured for use with a user device (not shown) such as, by way of non-limiting example, a personal entertainment device, a communication device such as a mobile phone, smart phone or personal digital assistant (PDA), a personal monitoring device, such as a pulse or respiration monitor, a personal computing device such as a tablet, a laptop, etc.

In the non-limiting example shown throughout the FIGS. 1A-17, the cable assembly 80 is configured as an earphone assembly including a pair of earpieces 82, sometimes referred to as earphones or ear buds, each configured to be selectively mounted in or on the ear 79 either just outside, or partially within, the outer ear canal. The cable assembly 80 may be of any configuration, including one or more cables. In one example, a single cable 81 may be bifurcated for use in a J-style (see FIG. 7A) or Y-style (see FIG. 7B) earphone cable assembly 80 to provide cable branches extending to each of the earpieces 82. The cable assembly 80 may include multiple cables and/or cable branches 81, some of which may terminate in or be connected to an electronic element such as an earpiece 82, microphone 32B, switch or control 32D, (see FIG. 7B).

Figure 4A:
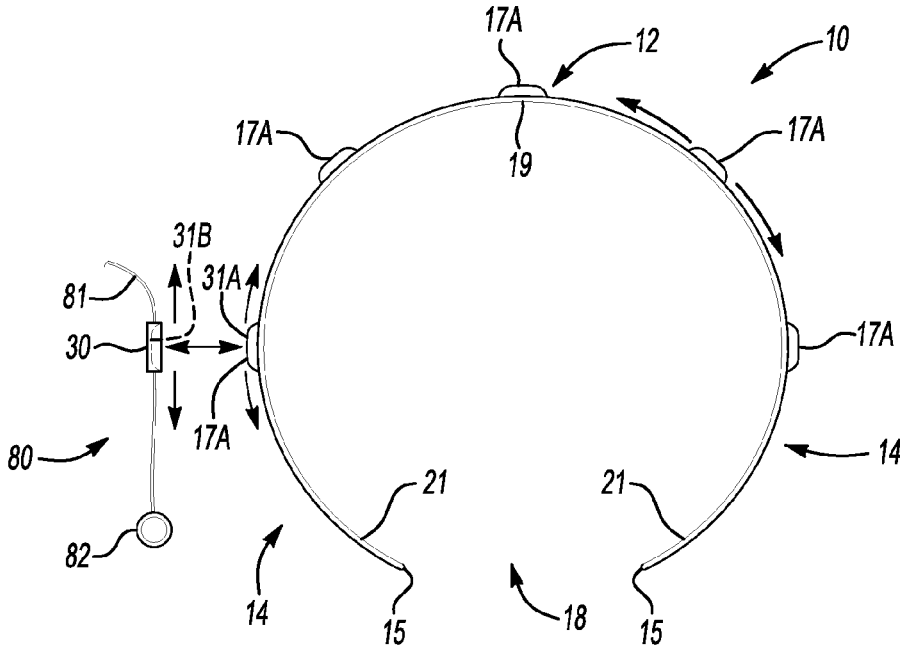
FIG. 4A is a schematic top view of the neckpiece of FIG. 1A including repositionable interfacing tethering elements.
Figure 4B:
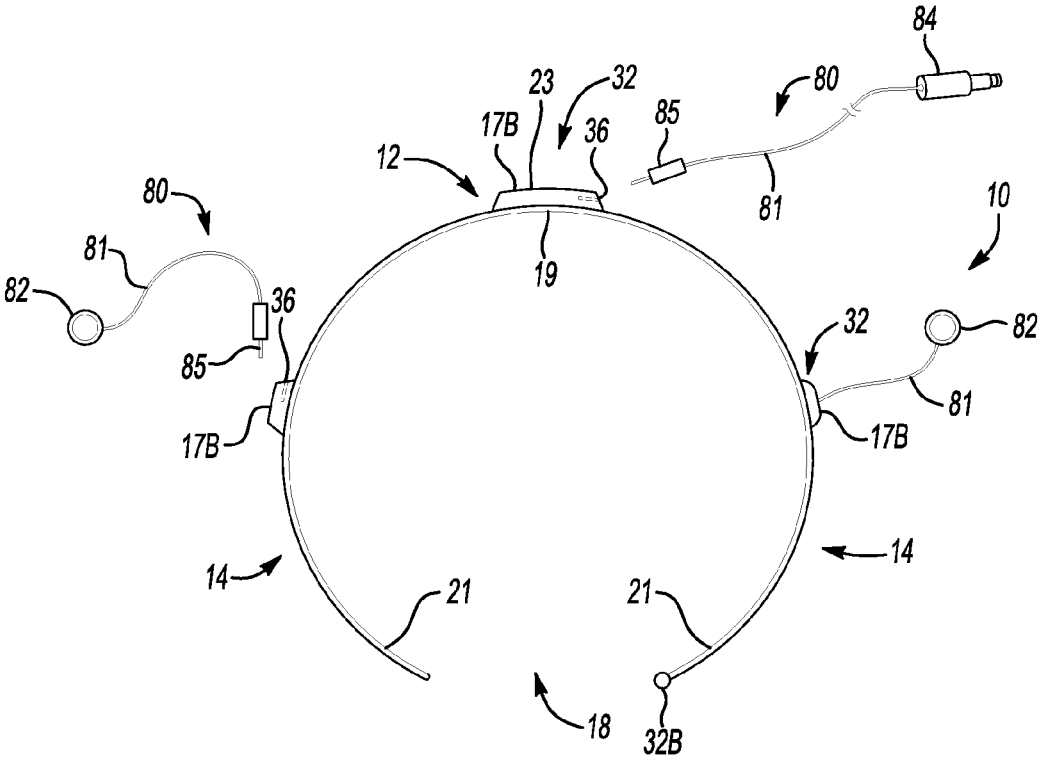
FIG. 4B is a schematic top view of the neckpiece of FIG. 1A including electrically connected tethering elements.

As shown in FIG. 4B, the cable 81 may terminate in or be electrically connected to one or more connectors, such as a plug or input connector 84 configured to connect the cable assembly 80 to a user device or power source, for example, and/or a terminal or output connector 85 for connecting the cable 81 to an electronic element 32, a electrical circuit via a jack 36, etc. It would be understood that the examples described herein and shown in the figures are illustrative and that the configuration of the cable 81 which may be tethered to the neckpiece 10 is non-limiting. For example, the cable 81 may be a non-electric cable or cable-like element which may be tethered to the neckpiece 10 for a functional purpose, such as a lanyard, and/or for a decorative purpose, such as a necklace or other ornamental element.

The neckpiece 10, when worn by the user 70 as shown in FIGS. 1A-1D, is located on the user's neck, which is generally indicated at 71. As understood and referred to herein, the user's neck 71 extends upward from but not including the user's shoulders 72 and downward from but not including the user's jaw line 73. The surface of the neck 71 may be described herein as including portions referred to herein as an anterior area 77, a posterior area 78 and lateral areas 76, where the lateral area 76 on a respective left and right side of the neck 71 separates the anterior area 77 from the posterior area 78. Each of the lateral areas 76 is proximate an ear 79 of the user 70. The posterior area 78 includes and extends from a nape area 75 corresponding to a relatively flat area of the posterior area 78 adjacent the cervical vertebrae. The width of the nape area 75 is approximately ten percent (10%) of the perimeter of the neck, where the perimeter of the neck may corresponds to the circumference of the neck 71 relative to a user or neck axis 11. The anterior area 77 includes and extends from a throat area 74 corresponding to the area of the neck 71 adjacent the throat and generally opposing the nape area 75. The width of the throat area is approximately twenty percent (20%) of the perimeter of the neck, e.g., 20% of the circumference of the neck 71.

As shown in FIGS. 1A-1D, the neckpiece 10 may be configured to retain the neckpiece 10 to the user's neck 71 in a mid-neck location, where a "mid-neck location", as defined herein, is a location on the neck 71 intermediate, e.g., between, the shoulders 72 and the jaw line 73. The neckpiece 10 may be located and retained in the mid-neck location such that the neckpiece 10 is not be in contact with the user's shoulders 72 and/or may not be supported by the user's shoulders 72. The neckpiece 10 includes opposing arm segments 14 which are operatively connected to each other. Each of the arm segments 14, which may be referred to herein as an arm or as an arm segment, terminates in an end 15. The neckpiece 10 may include a central segment 12 intermediate the arm segments 14. The arm segments 14 may be integral to the central segment 12, for example, formed continuously with or from the central segment 12. The central segment 12 may include an intermediate element 22 (see FIG. 2A) to which the arm segments 14 are operatively attached. The arms 14 and ends 15 are configured such that when the neckpiece is worn by the user 70, the ends 15 may be located in the anterior area 77 of the neck 70, e.g., located in contact with the anterior area 77 and/or immediately adjacent to the neck surface defined by the anterior area 77.

Figure 1D:
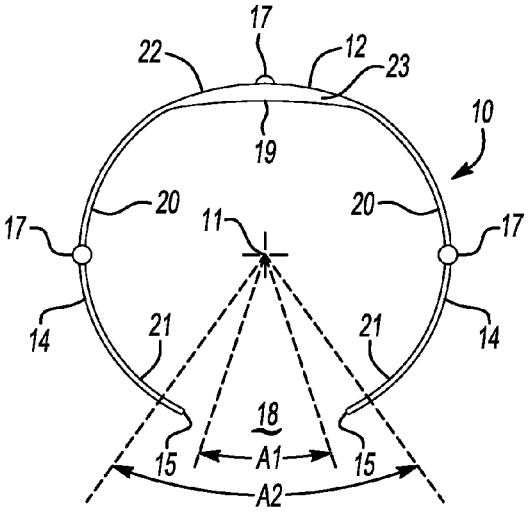
FIG. 1D is a schematic top view of the neckpiece of FIG. 1A including a nape element.

The arms 14 and ends 15 define an opening or throat access 18, also referred to herein as an access opening 18, configured to facilitate donning and doffing of the neckpiece 10 by the user 70. The throat access 18 may be configured to be sufficiently wide to enable the user 70 to don the neckpiece, e.g., to position the neckpiece 10 onto the neck 71 of the user 70, and to doff the neckpiece, e.g., to remove the neckpiece 10 from the neck 71 of the user 70. Further, the opening access 18 and/or the configuration and arrangement of the ends 15 may be such that the neckpiece 10 does not substantially interfere with or extend onto the throat area 74 sufficiently to cause annoyance and/or discomfort to the user 70. Referring to FIG. 1D, the access opening 18 may be configured to have a minimum opening size A1 when the neckpiece 10 is worn by the user, where the minimum opening size A1 is sufficient large to prevent discomfort to the throat area 74 and/or to the user 70 by the neckpiece 10 when donned, e.g., worn, by the user 71. By way of example, the minimum opening size A1 may correspond to a width of the access opening 18 which is between 15% and 35% of the perimeter of the neckpiece 10, where the perimeter of the neckpiece 10 is inclusive of the access opening 18, e.g., the perimeter of the neckpiece 10 is the summation of the individual perimeter lengths of each of the arm segments 14, the central segment 12 and the access opening 18. In a preferred example, the minimum opening size A1 corresponds to approximately 20% of the perimeter of the neckpiece 10, e.g., the minimum opening size A1 corresponds to the size of the throat area 74.

The access opening 18 may be configured such that when the neckpiece 10 is worn by a user 70, the access opening 18 has a maximum opening size A2, where the maximum opening size A2 corresponds to a configuration of the neckpiece 10 which retains the neckpiece 10 to the user's neck 71 such that the user 70 may move freely and any such movement by the user 70 does not significantly affect the retention of the neckpiece 10 to the neck 71. The maximum opening size A2 may be 45% of the perimeter of the neckpiece 10. In a preferred configuration, the maximum opening size A2 may correspond to a width of the access opening 18 which is between 20% and 40% of the perimeter of the neckpiece 10. In a more preferred example, the maximum opening size A2 is not greater than 35% of the perimeter of the neckpiece 10.

The maximum opening size A2 may correspond to the size and/or configuration of a front interface 21 defined by each of the arm segments 14, where the front interface portion 21 may be configured to interface with the anterior area 77 of the neck 71, and/or may be configured as one of at least one grasping interfaces defined by the neckpiece 10 and configured to exert a grasping pressure on the neck 71 when the neckpiece 10 is worn, where the grasping pressure exerted on the neck 71 is sufficient to secure or retain the neckpiece 10 in position on the user's neck 71. The access opening 18 may be configured within minimum and maximum opening sizes A1, A2 to define or provide front interface portion 21 of sufficient size to retain the neckpiece 10 to the user's neck 71 and/or to provide a grasping pressure on the neck 71 within predetermined pressure limits. The pressure limits for the grasping pressure may be predetermined considering the minimum grasping pressure required to retain the neckpiece 10 in position on the neck 71, a grasping pressure threshold corresponding to a comfort level of the user, and/or a grasping pressure required to sense a physiological parameter of the user, for example, using a sensing element 37 (see FIG. 5) positioned on the neckpiece 10 to interface with an area of the user's neck 71, such as the anterior area 77.

Still referring to FIGS. 1A-1D, one or more interface portions 19, 20, 21 configured to interface with corresponding areas of the user's neck 71 may be defined by the neckpiece 10. For example, the neckpiece 10 may define a nape interface portion 19 configured to interface with the corresponding nape area 75 of the user's neck 71. The nape interface portion 19 may be configured to define a substantially flat surface, such that the nape interface portion 19 may interface with nape area 75 by substantially complying with and/or conforming to the relatively flat nape area 75 adjacent the cervical vertebrae. Conformance of the substantially flat surface defined by interface portion 19 with the relatively flat nape areas 75 may enhance comfort of the user in wearing the neckpiece 10, and such that conformance of the surface of the nape interface portion 19 to the neck surface of the nape area 75 contributes to the retention of the neckpiece 10 in position on the wearer's neck 71, and/or to generating a grasping pressure exerted by the nape interface portion 19 on the nape area 75.

The front interface portions 21 may be configured to interface with the corresponding anterior area 77 of the user's neck 71, to provide a grasping pressure on the user's neck 71 and/or an interfacing neckpiece surface substantially conforming to the corresponding neck surface, as previously described herein. Similarly, the arm segment 14 may define a side interface portion 20 configured to interface with the corresponding lateral area 76 of the user's neck 71, to provide a grasping pressure on the user's neck 71 and/or an interfacing neckpiece surface substantially conforming to the corresponding neck surface, as previously described herein for the front and nape interface portions 21, 19. The neckpiece 10 may be configured such that two or more or the interface portions 19, 20, 21 are configured as grasping interfaces, and/or cooperate as grasping interfaces exert a grasping pressure on the neck 71 to retain the neckpiece 10 on and/or in position relative to the user's neck 71. For example, the neckpiece 10 may be configured such that the side interface portions 20 cooperate together or in combination with the rear interface portion 19 to provide a grasping pressure on the user's neck 71. In this example, the front interface portions 21 may be configured to extend into the anterior area 17 while exerting minimal contact pressure or exerting no pressure on the anterior area 77, such that the neckpiece 10 substantially encircles the circumference of the neck 17 to provide a second retention mechanism in addition to the first retention mechanism provided by the grasping pressure exerted by the side interface portions 20. "Substantially encircles" the circumference of the neck, as used herein, refers to the neckpiece 10 encircling the circumference of the neck 17 except for the circumferential length corresponding to the perimeter length of the access opening 18.

Figure 7A:
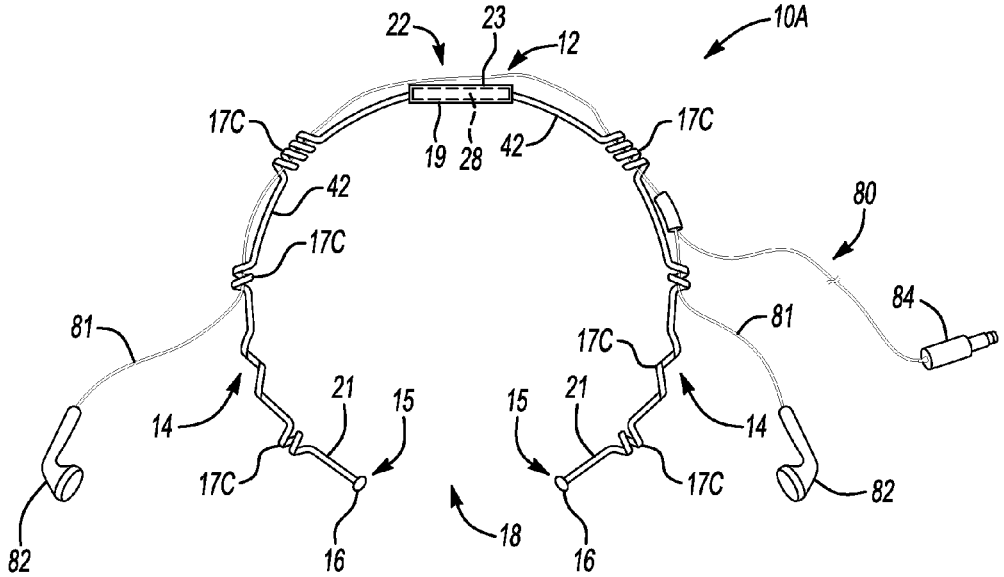
FIG. 7A is a schematic top view of the neckpiece of FIG. 1A including a compartment and spiral tethering elements.
Figure 7B:
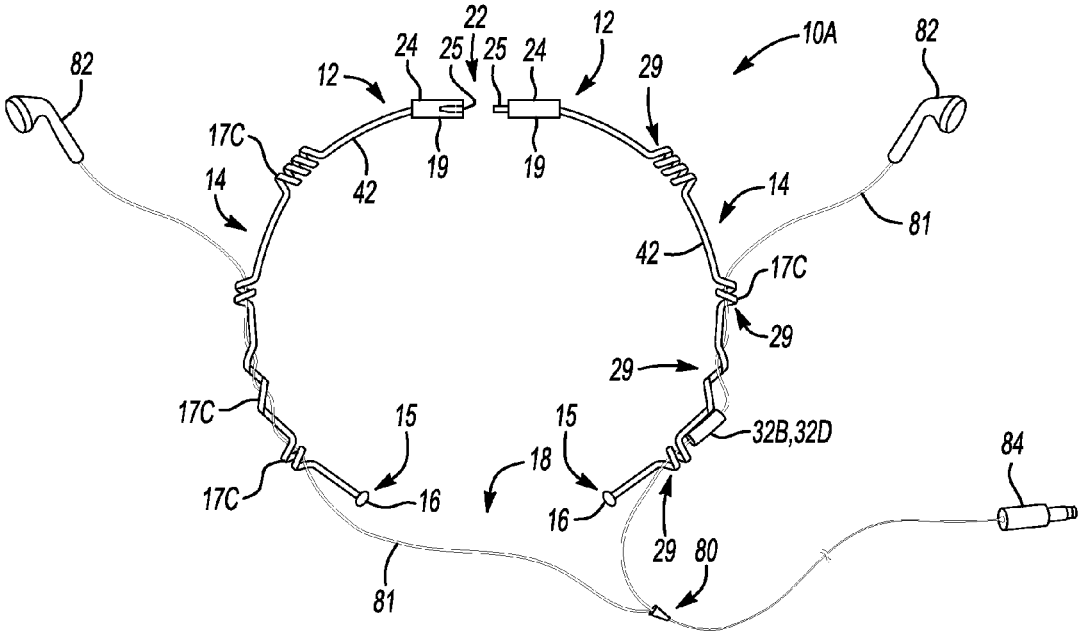
FIG. 7B is a schematic top view of the neckpiece of FIG. 7A including detachable arms.

As shown in FIGS. 1A-2B, a plurality of tethering elements 17 are defined by and/or operatively connected to the neckpiece 10, and configured to removably retain a cable 81 to the neckpiece 10. The number, location, distribution, type, arrangement and/or configuration of the tethering elements 17 on a neckpiece 10 may be varied as required to provide tethering points arranged to retain the cable 81 to the neckpiece 10 in a configuration convenient to and consistent with the needs of the user. The number, location, distribution, type, arrangement and/or configuration of the tethering elements 17 on a neckpiece 10 may be varied as required to provide or define one or more cable pathways 29 (see FIGS. 7B, 8C, 13B, 15B for example) for routing the cable 81 relative to the neckpiece 10 and/or relative to the tethering element 17. The cable pathway 29 may include all or a portion of the total number of tethering elements 17 of a neckpiece 10, and multiple cable pathways 29 may be defined by the arrangement of tethering elements 17 on the neckpiece 10, to provide optional configurations for the user 70 for attachment of a cable 81 and/or cable assembly 80 to the neckpiece 10. For example, FIGS. 1A, 7A-7B illustrate that the user 70 may selectively attach the cable assembly 80 to the neckpiece 10 using selected tethering elements 17 available on the neckpiece 10 to vary and/or customize the arrangement of the cable assembly 80 relative to the neckpiece according to the user's needs and/or preferences. For example, as shown in FIG. 1A, cable assembly 80 is tethered to the neckpiece 10 such that the cable 81 extending to a user device (not shown) carried on the user's person extends from a tethering element 17 located in the central segment 12 of the neckpiece 10, proximate the nape area 75, and down the user's back, to a user device positioned in posterior location on the user's person or, for example, in a backpack carried by the user. The cables 81 connecting the earpieces 82 are tethered to tethering elements 17 located on the arm segments 14 proximate the lateral portions 76 of the user's neck and extending therefrom to the user's ears 79. The length of cable 81 extended from the tethering elements 17 to extend the earpieces 82 to the user's ears 79 may be varied to provide sufficient slack or loose cable between these points to allow complete freedom of movement of the head, neck and shoulders while retaining the earpieces 82 in the user's ears 79, while be adjustable to minimize the weight of the extended length of the cable 81 unsupported by the neckpiece 10.

FIG. 7A shows an example of the cable assembly 80 tethered to a selected few of the plurality of tethering elements 17C on the neckpiece 10A, where the cable assembly 80 is arranged such that the cable 81 extending to a user device (not shown) extends from a tethering element 17 located on the arm segment 14 of the neckpiece 10 proximate the lateral area 76 of the user's neck 71, such that the cable 81 may be conveniently routed, for example, to a user device carried on an armband or other lateral location on the user's person. FIG. 7B shows an example of the cable assembly 80 tethered to a different combination of tethering elements 17C to arrange the cable assembly 80 such that the cable 81 extending to a user device (not shown) extends from a tethering element 17 located on the arm segment 14 of the neckpiece 10 proximate the anterior area 77 of the user's neck 71, such that the cable 81 may be conveniently routed, for example, to a user device carried in a shirt pocket or other anterior location on the user's person.

Figure 2A:
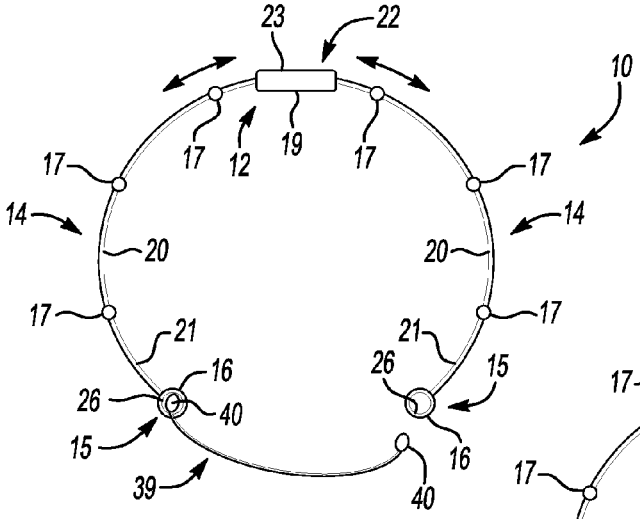
FIG. 2A is a schematic top view of the neckpiece of FIG. 1A including extendable arms adjustably connected to a nape element and connectable with a clasp.
Figure 8A:
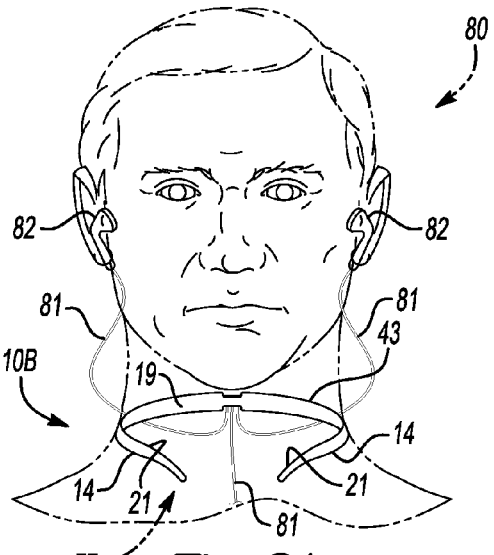
FIG. 8A is a schematic front perspective view of an example configuration of the neckpiece of FIG. 1A.
Figure 8B:
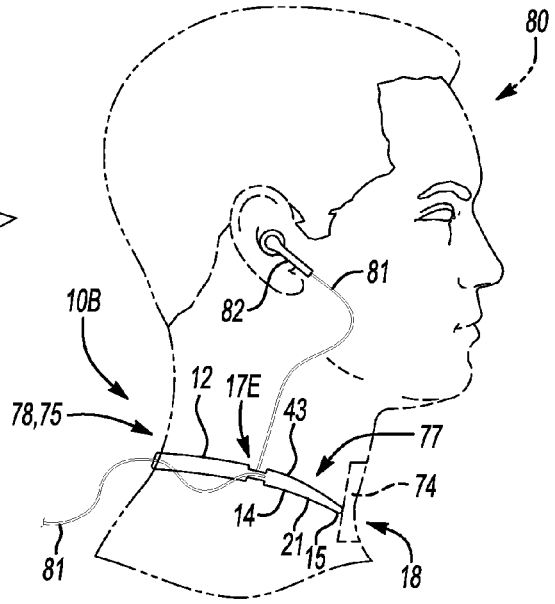
FIG. 8B is a schematic side view of the neckpiece of FIG. 8A.
Figure 8C:
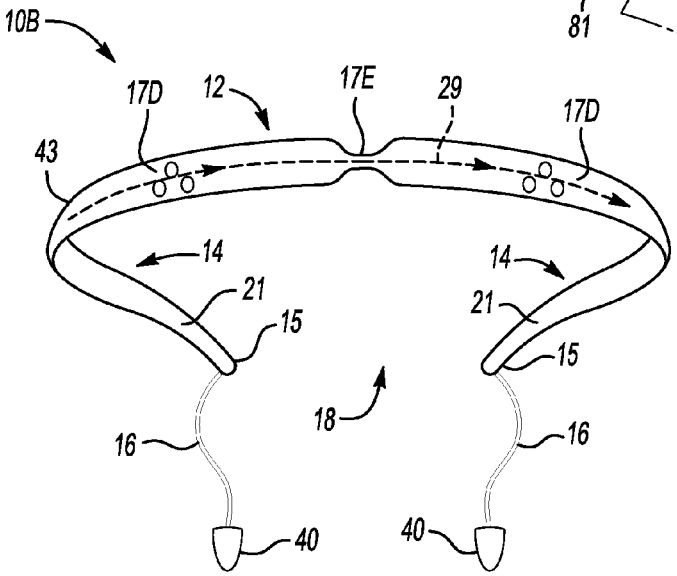
FIG. 8C is a schematic rear view of the neckpiece of FIG. 8A including a clasp.
Figure 8D:
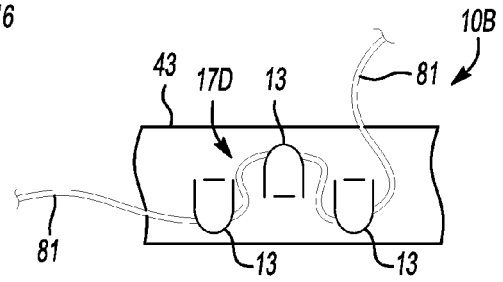
FIG. 8D is a partial sectional schematic view of a tethering element of the neckpiece of FIG. 8C.

As shown in FIGS. 2A-3B, the width and/or size of the access opening 18 may be extendable to facilitate donning and doffing of the neckpiece 10 and/or to adjust the size of the access opening 18 to the size and/or grasping pressure to a specific user's neck 71. FIG. 2A shows arm segments 14 adjustably connected to an intermediate element 22 such that the arm segments 14 can be extended or contracted relative to the intermediate element 22 to vary the size of the access opening 18 and/or the perimeter of the neckpiece 10. A clasp element 39 may be provided, where the clasp element 39 may include one or more clasping features 40 for attachment of the clasp element 39 to corresponding features defined by the neckpiece 10. In the example shown in FIG. 2A, the ends 15 may each define an end feature 16 configured to operatively interface with the clasping features 40 to connect the clasp element 39 to the neckpiece 10 at a clasping interface 26. The clasp element 39 may be used to provide an additional means of retaining the neckpiece 10 to the user's neck 71, for example, during higher levels of user activity, vigorous movement and/or unusual or non-upright body positioning. The clasp element 39 may be configured such that it is not close-fitting to the neck 71, such that a clearance is maintained between the clasp element 39 and the throat area 74 in use. The clasp element 39 may be configured to adjust the size of the access opening 18. In the example shown, the clasp element 39 may be configured to exert a spring load on the arm segments 14 when connected to the neckpiece ends 15, which may act to contract the size of the access opening 18 by drawing the arm segments 14 together, or alternatively, the clasp element 39 may be configured to exert a spring load on the ends 15 and arm segments 14 to expand the size of the access opening 18, to vary the size of the access opening 18, thereby varying one or more of the perimeter of the neckpiece 10 and the grasping force exerted by the neckpiece 10 on the user's neck 71. Other example configurations of clasp elements 39 are shown, for example, in FIGS. 8C and 9. As shown in FIG. 8C, the clasp element 39 may be configured as flexible straps or cords configured as end features 16 attached to ends 15, and including clasping interfaces 40. The end features 16 may be configured to be tied together, for example, or, the clasping features 40 may be configured to operatively connect to each other. In one example, the clasping features 40 may be configured, for example, as magnetic elements which may be magnetically connected to each other to operatively connect the ends 15. As shown in another example in FIG. 9, the clasp element 39 may include an adjustable feature 41, and the clasping feature 40 and clasp interface 26 may be configured as hook and loop (Velcro™) type connectors. The examples provided herein are illustrative and non-limiting, and it would be understood that other configurations of clasp elements 39 and clasp interfaces 26 may be used. For example, the clasp element 39 may include a chain or other linked member, an elastic member, a textile member, and/or a variety of fastening elements including clips, and the like.

Figure 2B:
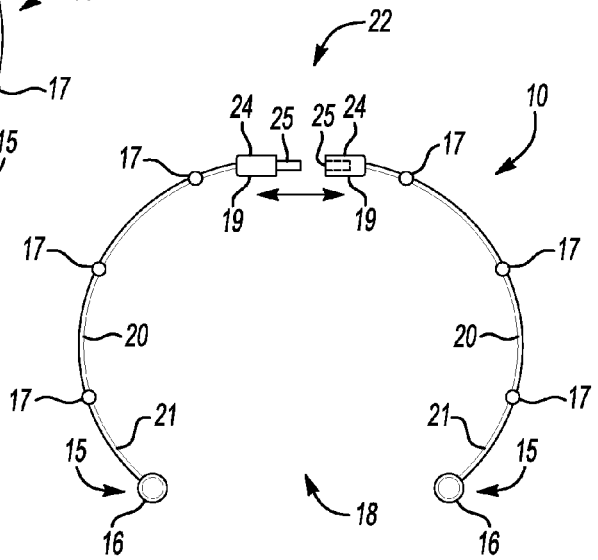
FIG. 2B is a schematic top view of the neckpiece of FIG. 2A with detachable arms.

Referring now to FIG. 2B, the neckpiece 10 may include connecting elements 24 which are detachable from each other such that the arm segments 14 are detachable from each other. Detachment of the connecting elements 24 increases the width of the access opening 18 and further facilitates donning and doffing of the neckpiece 10 by allowing separation of the arm segments 14. At least one of the connecting elements 24 may include an orientation feature 25 to orient and/or align one arm segment 14 relative to the other arm segment 14 during reattachment. The connecting elements 24 and/or orientation features 25 may be of any configuration suitable to function as a selectively disconnectable interface and/or provide an alignment function. For example, the connecting elements 24 may be magnetic connectors including for example, rare earth type magnets, snap connectors, threaded connectors, interference fit connectors, blade and slot connectors, or the like. The orientation features 25 may be integral to the connecting elements 24, as would be the case for blade and slot connectors, or self-orienting magnetic fasteners, for example. It is understood that the examples provided herein are illustrative and not intended to be limiting, such that other configurations of the connecting elements 24 and/or orientation features 25 may be used.

Figure 3A:
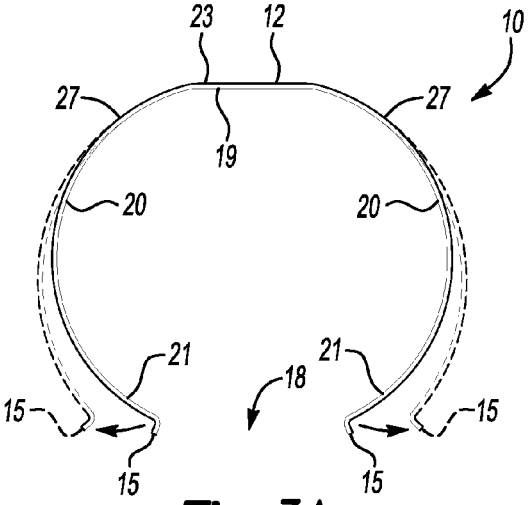
FIG. 3A is a schematic top view of the neckpiece of FIG. 1A including expandable arms.
Figure 3B:
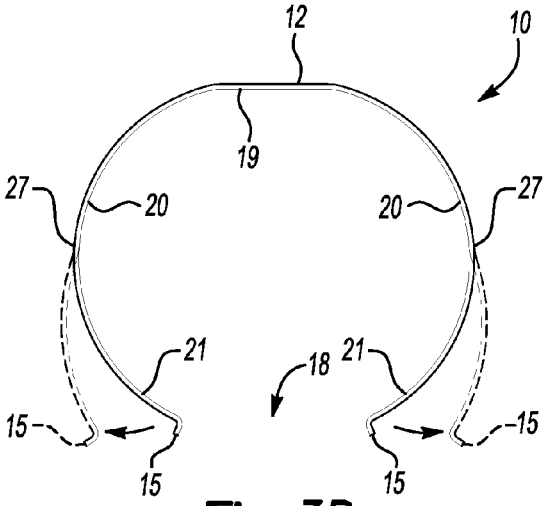
FIG. 3B is a schematic top view of the neckpiece of FIG. 1A including hinged arms.

FIG. 3A shows arm segments 14 adjustably connected to a central segment 12, for example, via a hinge element 27, which may be a living hinge defined by the arm segments 14 or by the arm segments 14 in combination with the central segment 12 such that the arm segments 14 can be extended or contracted relative to the central segment 12 to vary the size of the access opening 18 and/or the perimeter of the neckpiece 10. Similarly, FIG. 3B shows arm segments 14 adjustably connected via a hinge element 27, which may be an adjustable hinge such that the arm segments 14 can be extended or contracted relative to the central segment 12 to vary the size of the access opening 18 and/or the perimeter of the neckpiece 10, where the arm segments 14 may be retained in the extended or contracted position during use by locking or otherwise manipulating the hinge element 27 to retain the arm segments 14 in the adjusted position.

Referring now to FIGS. 4A-6B, shown are various configurations of elements which can be combined to configure the neckpiece 10. FIG. 4A shows a neckpiece 10 including repositionable tethering elements 17A, where each of the tethering elements 17A is repositionable relative to the neckpiece 10 such that the location of each tethering element 17A may be varied, and the distribution of the tethering elements 17A along the perimeter of the neckpiece 10 may be varied, for example, to customize the arrangement of the tethering elements 17A according to a user preference, to correspond to the cable 81 and/or cable assembly 80 being tethered by the tethering elements 17A, to adjust the location of the tethering elements 17A to complement physiological characteristics of the user 70, and the like. FIG. 4A further shows a tethering interface 31A defined by the tethering element 17A and corresponding to a tethering interface 31B defined by a cable tether 30, where the cable tether 30 may be considered a component of the tethering element 17A including the tethering interface 31A. The cable tether 30 may be configured to be removably attached to the cable 81 and may be repositionable along the length of the cable 81, for customization to the user's needs. The cable tether 30 may provide additional stability to cable 81 and/or to the tethering connection established by the tethering interfaces 31A, 31B. In one example, the tethering interfaces 31A, 31B may be detachable snap type connecting interfaces.

FIG. 4B shows a tethering element 17B which may include a jack 36 configured to receive a connector 85 of a cable 81, such that the cable 81 may be retained to the tethering element 17B via the connector 85 and the jack 36. In one configuration, the tethering elements 17B may be electrically connected to each other via the neckpiece 10, such that a first cable 81 may be electrically connected to a first tethering element 17B and a second cable 81 may be electrically connected to a second tethering element 17B via respective connectors 85 and jacks 36, to establish an electrical connection between the first and second cables 81 and/or between electronic elements electrically connected to the first and second cables 81.

Figure 5:
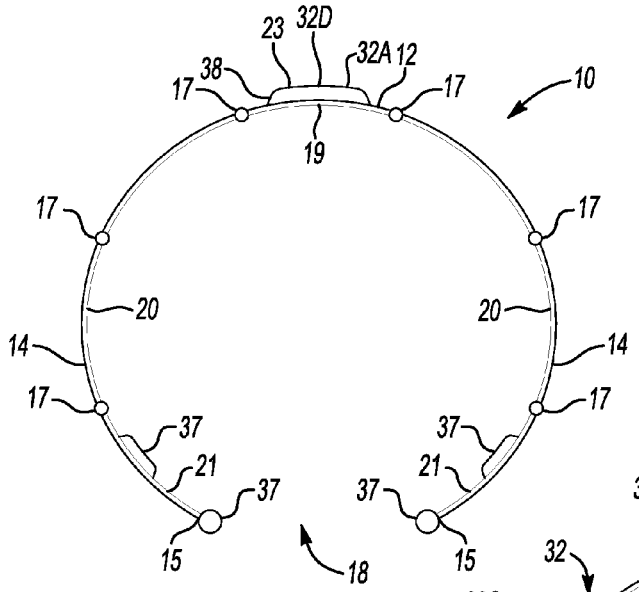
FIG. 5 is a schematic top view of the neckpiece of FIG. 1A including a sensor.
Figure 17:
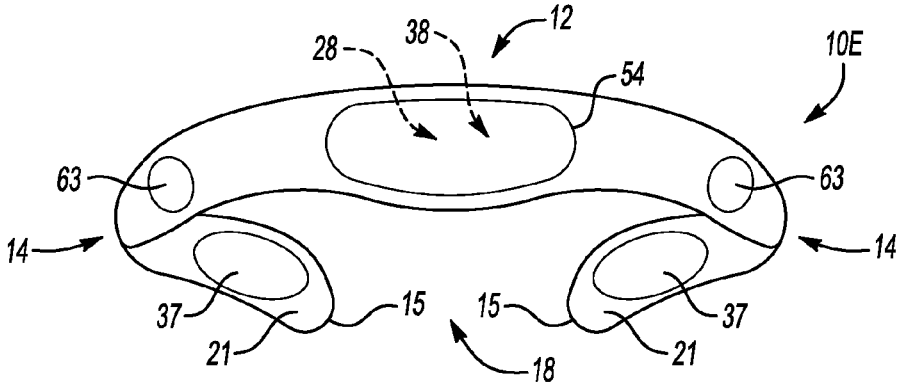
FIG. 17 is a schematic rear perspective view of an example configuration of the neckpiece of FIG. 15A including a sensor.

Referring now to FIG. 5, shown is a neckpiece 10 including at least one sensing element 37 operatively attached to the neckpiece 10. The sensing element 37 may be configured to sense a physiological parameter of a user 70 wearing the neckpiece 10, where the sensing element interfaces with the user 70. A monitor 38 may be operatively attached to the neckpiece 10 and the sensing element 37 may be in operative communication with the monitor 38, through a wired connection using a cable which may be tethered to the neckpiece using tethering elements 17, through a wired connection via the neckpiece 10, or via a wireless connection, where the monitor 38 and/or the sensing element 37 may include an antennae and/or transmitter/receiver element, which may be a Bluetooth™ element 32A, for example. The monitor and/or the sensing element 37 may include a switch 32D for activating and deactivating the monitor and/or the sensing element 37. By way of example, the sensing element 37 may be located proximate and/or within the front interface portion 21 such that the sensing element 37 is in operative communication with and/or interfacing with the anterior area 77 of the user's neck 71. In the example shown, the sensing element may be located proximate the interface portion 21 by operatively attaching the sensing element 37 to the portion of the arm segment defining the front interface portion 21 and/or by incorporating the sensing element 37 into an end feature operatively attached to or defined by the arm end 15. The sensing element 37 may be configured to sense a physiological parameter of the user 70, such as the user's pulse, temperature, respiration rate, glucose level, hydration status, oxygen saturation, or the like. These examples are not intended to be limiting, and other types of sensing elements 37 may be used, such as an acoustic sensor positioned on the front interface portion 21 proximate the trachea or larynx. The sensing element 37 may be configured to output a signal corresponding to a measurement or other indicator of the status of the physiological parameter being sensed to, for example, the monitor 38, which may be configured to receive the signal and record, store, display, analyze and/or output a measurement or other indicator of the status of the physiological parameter to the user 70 or to a user device (not shown) in communication with the monitor 38 via a cable 81 operatively attached to the monitor 38 which may be tethered to the neckpiece 10, and/or wirelessly to the user device via the Bluetooth™ element 32A, for example. The sensing element 37 and/or the monitor 38 may be configured to output an alert and/or an alarm, for example, when the sensing element 37 senses a physiological parameter of the user 70 is outside threshold or alert limits established for that physiological parameter. For example, limits may be established to alert a user 70 when a threshold pulse rate is reached during an exercise event, or when a alert limit has been reached for a user's glucose level being sensed by the sensing device 37. The examples provided herein are non-limiting, and other configurations are possible. For example, multiple sensing elements 37, each configured to sense a different physiological parameter of the user, may be operatively attached to the neckpiece 10 in communication with a monitor 38 or other monitoring device, which may be, for example, a user device. A tethering element 17 and or the neckpiece 10 may be configured to selectively receive sensing elements 37, such that the user 70 may selectively attach a sensing element 37 to the neckpiece 10 only during those times where sensing of a physiological parameter is desired, for example, during exercise or when parameter monitoring is required for a medical evaluation or the like. The sensing element 37 and/or neckpiece 10 may be configured such that the sensing element 37 is repositionable on the neckpiece 10 to optimize the interface between the sensing element 37 and the user's neck area to improve sensing accuracy or to customize the interface for a specific user. The examples described herein and illustrated by the figures are not intended to be limiting, and other configurations may be used. Various combinations of sensor types and neckpiece configurations are possible. For example, FIG. 17 shows a neckpiece 10E including sensing elements 37 positioned in the front interface portions 21. The sensing elements 37 may be in wired or wireless communication with a monitor 38 removably positioned in a user accessible compartment 28 defined by the neckband 10E. A cable 81 (not shown in FIG. 17) connecting the sensors 37 to the monitor 38 may be tethered via an internal channel 62 (see FIG. 15B), where the internal channel 62 may also be used to concurrently tether at least another cable 81 for attachment, for example, to a user device (not shown).

Figure 6A:
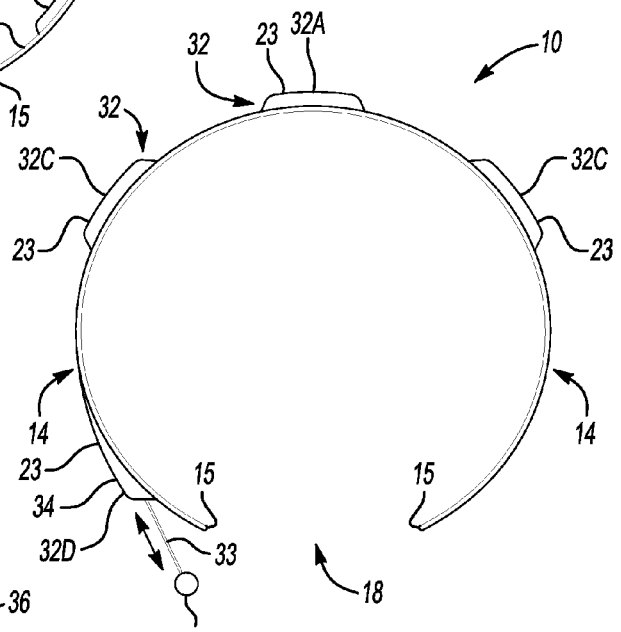
FIG. 6A is a schematic top view of the neckpiece of FIG. 1A including an electronic component.
Figure 6B:
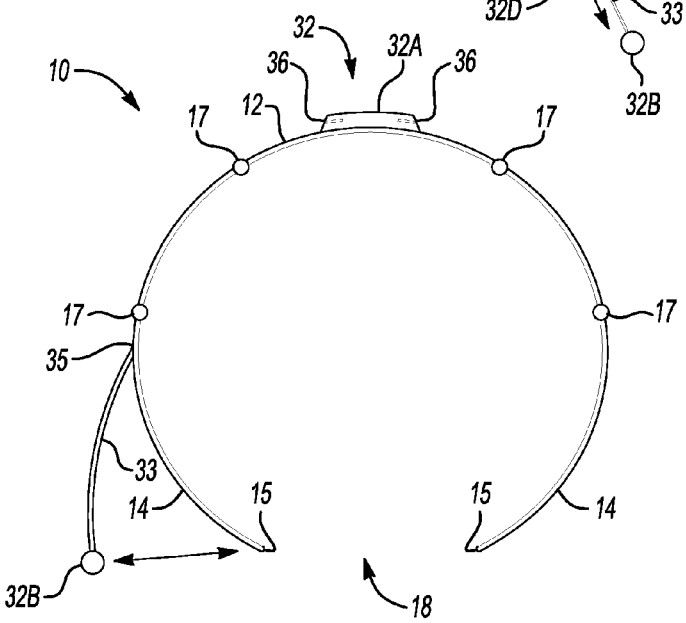
FIG. 6B is a schematic top view of the neckpiece of FIG. 1A including tethering elements and an electronic component.

The neckpiece 10 may include one or more electronic elements 32 which may be operatively and/or selectively connected to the neckpiece 10 and may be configured to be in electrical communication with each other and/or a user device. In the example shown in FIG. 6A, the neckpiece 10 may include an electronic element 32, such as a microphone 32B, positioned on the neckpiece such that it is conveniently accessible to the user 70 wearing the neckpiece 10. In the example shown, the neckpiece 10 may include a microphone mount 33 adjustably connected to a microphone casing 34, such that the microphone 32B is repositionable relative to the user 70 wearing the neckpiece 10. A switch 32D may be configured to activate and deactivate the microphone 32B, control volume, and the like. The microphone 32B including the casing 34, mount 33 and switch 32D may be selectively connected to the neckpiece 10 such that these elements may be detached from the neckpiece 10 when not in use. Other electronic components, such as speakers 32C and a transmitter/receiver element 32A, which may be a Bluetooth™ element or the like, may be operatively and/or selectively attached to the neckpiece 10 and each may be in electrical communication with at least one other electronic component 32, either through a wired connection via a cable or cables 81 tethered via one or more tethering elements 17 (not shown in FIG. 6A for clarity of illustration), via the neckpiece 10 so configured to electrically connect the electronic elements 32, or through a wireless connection. Another configuration of the microphone 32B is shown in FIG. 6B, wherein the microphone 32B may be hingably connected via a microphone hinge 35 to the neckpiece 10 such that it may be extended in use and retracted to the neckpiece 10 for storage and during non-use periods. In the example shown, the neckpiece 10 may include a Bluetooth™ element 32A, which may be in electrical connection with the microphone. The neckpiece may include at least one jack 36 to receive, for example, a cable 81 including an earpiece 82, such that the cable 81 may be tethered to the neckpiece via the jack 36 and/or by tethering the cable 81 to at least one tethering element 17. The examples described herein and illustrated by the figures are not intended to be limiting, and other configurations of electronic components 32 including electronic components such as sensors 37 and neckpieces 10 may be used.

FIGS. 7A through 17 show example configurations of neckpieces 10A-10F described herein as non-limiting illustrative examples, and include neckpiece features and elements, such as but not limited to, tethering elements 17A-17H, which may be used with more than one configuration of neckpiece 10, and/or in configurations, combinations, embodiments and arrangements additional to those shown for illustrative purposes in the included figures. Various materials, processes and configurations may be combined to provide a neckpiece 10. The neckpiece 10 may include one or more display surfaces 23, as shown by way of non-limiting example in FIGS. 1D, 4B, 2A, 3A, 5, 6A, 7A, 9, 10A, 13A, 15A, and 16A. The display surface 23 may be configured to display a logo, trademark, graphic including word graphic, text or ornamental feature, which may be applied to or incorporated into the display surface 23 by any suitable method including printing, stamping, etching, embossing, sewing, embroidery, painting, coating, etc. The various surfaces of the neckpiece 10 may be configured as decorative and/or ornamental surfaces, which may include color, texture, graphics, applique, inserts, or other embellishments which may appeal to a user aesthetic. Surface features, textures and/or embellishments may be configured for functional purpose or a combination of functional and/or ornamental purpose. For example, an interface portion such as interface portions 19, 20, 21 may be textured, coated or otherwise surface treated for wearing comfort of the user 70, to provide a tacky or conforming surface for traction between the neckpiece 10 and neck 71 in use, for cushioning, air flow, ventilation, or other like purposes. The neckpiece 10 may be sized, uni-sized, or adjustable according to the user's application and the configuration of the neckpiece 10. Designs and configurations of neckpiece 10 may include the use of self-moldable features, extendable/retractable parts and user self-customizing through trimming, bending, or installation of pads including size adjusting pads such as pads 55 shown in FIG. 10A, tacky or adhering pads such as pads 65 shown in FIG. 16B which may be adhered to the neckpiece 10 for use as a retention feature and/or to adhere an embellishment or component such as the textured pads 65 shown in FIG. 16B. End features 16 may be functional and/or ornamental. For example, the end feature 16 shown in FIG. 7A may be a configured as a bulbous member for ornamental purposes and to blunt the end 15 for ergonomics. The neckpiece 10 may be pre-tensioned to generate a grasping pressure against the user's neck 71 for retention of the neckpiece 10 in position during use.

Figure 15A:
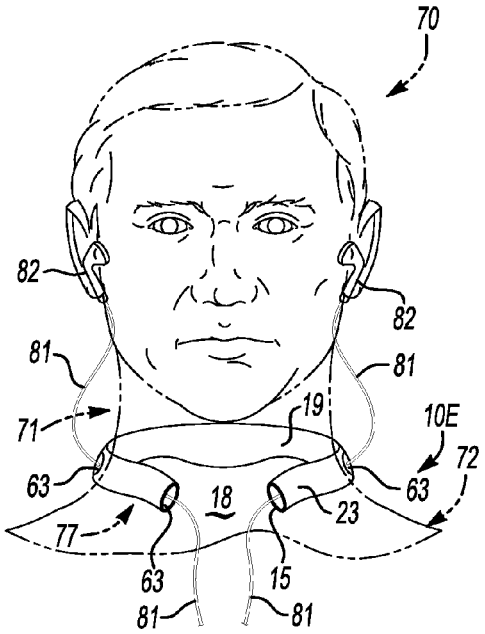
FIG. 15A is a schematic front perspective view of another example configuration of the neckpiece of FIG. 1A defining an internal channel.
Figure 15B:
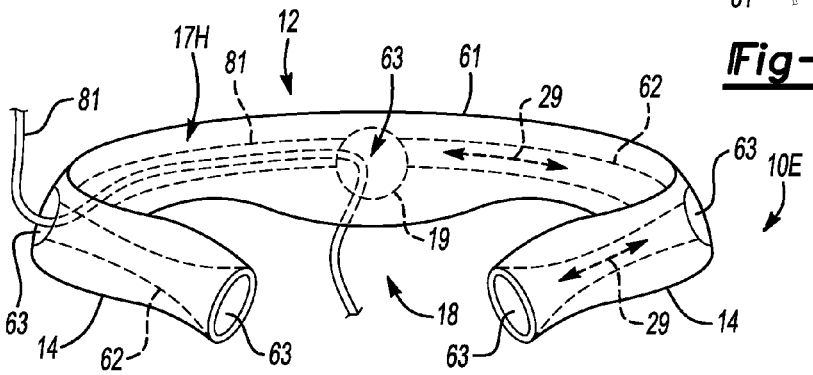
FIG. 15B is a schematic front perspective view of the neckpiece of FIG. 15A.
Figure 15C:
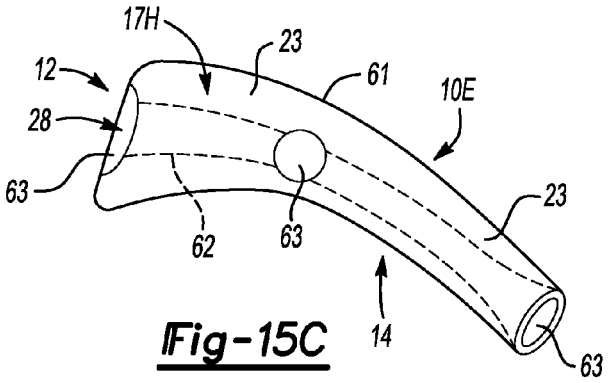
FIG. 15C is a schematic side view of an example configuration of the neckpiece of FIG. 15A.

The neckpiece 10 may be configured in different shapes. For example, a neckpiece 10A shown in FIGS. 7A-7B may include one or more wire segments 42. A neckpiece 10 may include a band 43, which may be a relatively narrower band 43 as shown in FIGS. 8A-8D, a relatively wider band 43 as shown in FIGS. 9A-13A, or a band 43 having a width therebetween. The neckpiece 10 may include a tubular portion 61 defining an interior channel 62, as shown in FIGS. 15A-15C.

The neckpiece 10 may be made from lightweight materials such as plastics, polymers, composites, and metal alloys to enhance comfort, ease of retention to the neck, and performance. The body of the neckpiece 10, for example, the wire segment 42, band 43 or tubular portion 61, may be comprised of lightweight materials suitable for forming the configuration of the body of the neckpiece 10 as required for performance and function. Lightweight materials which may be used include, by way of non-limiting example, stainless steel, aluminum alloys, titanium alloys, plastics and other polymers, carbon fiber, foams, fiberglass, combinations of these and/or like materials and/or their combinations. Smart materials, including shape memory alloys such as Nitinol™ and shape memory polymers, may be used to form the neckpiece 10 and/or in combination with other materials to form the neckpiece 10, where the smart material properties may be utilized for the formation of complex shapes including integral tethering elements such as the helical or spiral tethering elements 17C shown in FIGS. 7A and 7B, of other shapes or embellishing or ornamental features.

Figure 14:
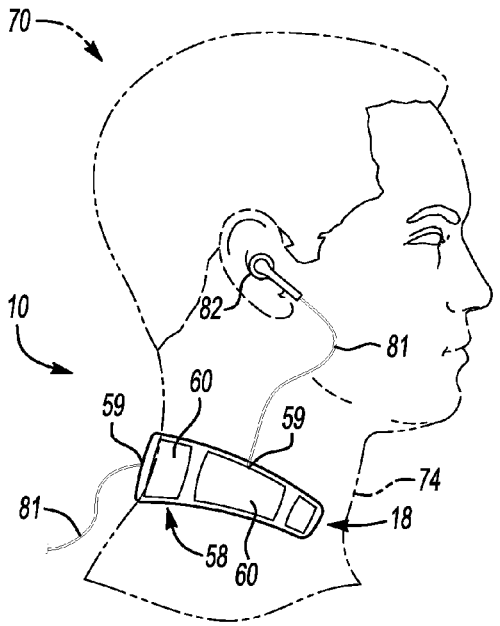
FIG. 14 is a schematic side view of the neckpiece of FIG. 1 including a neckpiece cover.

A cover, sleeve or casing generally indicated at 58 in FIG. 14 may be used in conjunction with the neckpiece 10, for functional and/or ornamental purpose. The casing 58 may include at least one display surface 60 which may be configured and/or surface treated as described for the display surfaces 23 of the neckpiece 10. The casing 58 may be water resistant and/or be otherwise configured to be protective of the neckpiece 10, the cable 81, and/or components including electronic components 32 which may operatively attached to the neckpiece 10, for example, when worn in wet environments or from user perspiration. The casing 58 may include one or more access points 59 for routing the cable 81 into or out of the casing 58. The casing 58 may be cushioned, ventilated, textured, include an absorbent layer, which may be a replaceable layer, or be otherwise configured for the comfort of the user 70 and/or for durability of the neckpiece 10. the casing 58 may include a user accessible compartment (not shown in FIG. 14) configured for user storage of personal items which may include personal identification, money, personal user devices such as phones, music players and the like, batteries, etc.

The neckpiece 10 may be made partially, substantially or completely of wire, as shown in FIG. 7A and 7B, and generically represented in FIGS. 1A-6B. The wire segments 42 (see FIG. 7A) may be made of a metal wire, and where the metal may be one of, for example, stainless steel, aluminum based, spring steel, titanium based or other alloy. In one example, the wire may be made of 304 stainless steel having a round cross section area with a diameter of approximately 1.4 mm, e.g., within mill tolerance of 1.4 mm. In another example, a wire made of titanium 422 may be used, preferably having a gage greater than 1.5 mm. Shape memory alloys such as Nitinol™ may be used, where the shape memory properties may be utilized to form the neckpiece 10 including tethering elements 17 such like the spiral and/or helical tethering elements 17C defining a conduit configured as a cable pathway 29 through the helix or spiral, or to form other multi-dimensional tethering element shapes and/or ornamental features of the neckpiece 10. The metal alloy is preferably a lightweight alloy to minimize the weight of the neckpiece 10 for the wearing comfort of the user 70. In one example, the neckpiece is configured to weigh less than 35 grams, and preferably less than 26 grams.

The wire segments 42 may be coating, painted, plated, or otherwise surface treated with an organic, non-organic, polymeric or metallic coating, partially or fully covered with another material, including a textile, by wrapping, encasing, sleeving, etc. for functional, ornamental, and/or durability purposes. The wire segments 42 may have a cross-sectional area which is constant throughout the neckpiece 10, or may have a cross-sectional area which is variable along its length for ornamental purposes, to facilitate forming of the arm and/or central segments 14, 12, to facilitate forming and/or attachment of tethering elements 17, for other functional or decorative purpose, etc. For example, referring to FIG. 1D, the neckpiece 10 as shown may be formed of in total from a wire segment 42, where the cross-section area of wire 42 may be generally round or rectangular within the arm segments 14 and may be modified to define a central segment 12 having a generally flat nape interface portion 19. The wire segment 42 may include other configurations of cross-sectional shapes and/or areas. For example, the wire segment 42 or portions thereof may have cross-sectional shapes and/or areas which are round, oval, square, rectangular, triangular or other geometric shapes for functional and/or decorative purpose.

The neckpiece 10A may include an intermediate element 22 connecting the arm segments 14. The arm segments 14 may be adjustable relative to intermediate element 22 as shown in FIG. 2A, to modify at least one of the size of the access opening 18 and the perimeter of the neckpiece 10A for ease of donning and doffing the neckpiece 10A and/or to adjust the perimeter size and/or grasping pressure of the neckpiece 10A to a specific user 70. The intermediate element 22 may include a compartment 28 for receiving the adjustable arm segments 14. In another example, the compartment 28 may be configured as a user accessible compartment to receive components of the neckpiece 10A which may include one or more electronic components 32 as described previously herein. The neckpiece 10A may include connecting elements 24 as described previously related to FIG. 2B, which may define and/or include an orientation feature 25. In one example, the connecting elements 24 may include magnetic elements, for example, rare earth magnets, which may be used to retain one connecting element 24 to the other. The magnetic elements may be self-orienting by magnetic properties, complementary shapers or otherwise to provide an integral orientation feature 25.

The arm segments 14 include a plurality of helical and/or spiral tethering elements 17C which are formed from portions of the wire segment 42. The spiraled or helical portion, referred to herein as the spiral portion for simplicity of description, defines a conduit or cable pathway 29 through which a cable 81 may be routed to retain the cable 81 to the tethering element 17C and the neckpiece 10A. The cable 81 may be routed through the cable pathway 29 by twisting the cable between or among the spirals to position the cable 81 in the pathway 29, for example. One or more of the tethering elements 17C and/or a portion of the spiraled length of a tethering element 17C may be used to define the cable pathway 29 and retain the cable 81 to the neckpiece 10. The cable pathway 29 is customizable by the user 70 by user selection of the number and position of tethering elements 17C used to retain the cable 81 to the neckpiece 10 and the pattern and/or order in which the cable 81 is engaged to the selected tethering elements to define the cable pathway 29. It would be understood that other elements and features of the neckpiece 10 described herein may be combined with or adapted to the neckpiece 10A. For example, the neckpiece 10A may include a clasping element 39, sensing elements 37, and/or electronic components 32. The spiraled portions of the wire segment 42 defining the tethering elements 17C may act as springs to define living hinges which may allow extension of the arm segments 14 as shown in FIG. 3A during donning and doffing of the neckpiece 10A. Further, the spiral tethering elements 17C may be configured and/or distributed along the arm segments 14 to pre-tension the neckpiece 10A, such that the pre-tensioning of the neckpiece 10 generates a grasping pressure to retain the neckpiece 10A at a mid-neck location of a user 70.

The band 43 may be configured as a relatively narrower band, which may have a vertical band width (as worn by the user 70) of 20 mm or less (approximately 0.75 inches or less). In one example, the band 43 may have a vertical band width of less than 13 mm (less than approximately 0.5 inches).

The band 43 may be formed in different sizes for various size users 70, which may include providing bands 43 formed with different perimeter sizes such that a size may be selected similar to selecting a shirt by a collar size, and/or may be formed with various levels of pre-tensioning and therefore grasping pressure, such that a user may select a band 43 having a relatively lighter or heavier (greater) grasping force depending on the user preference, comfort objectives, and/or anticipated activities during use, for example.

The band 43 may be pre-tensioned during forming to generate a grasping pressure to retain the neckpiece 10B at a mid-neck location of a user 70. As described previously, the band 43 may be formed to define rear interface portion 19 defining a generally flat surface which may cooperate with the front interfacing portions 21 and/or side interface portions 20, and/or the side interface portions 20 may cooperate to generate a grasping pressure to retain the neckpiece 10B at a mid-neck location of a user 70. The neckpiece 10 and/or the band 43 may be configured to define living hinges 27 as described previously, to allow extension of the size of the access opening 18 during donning and doffing. The neckpiece 10 and/or band 43 may be made of a metal-based or nonmetallic material. Examples of the materials from which the band 43 may be made include stainless steel, carbon fiber, titanium, Nitinol™, polymers, including reinforced polymers and/or composite materials.

The band 43 of the neckpiece 10B may include one or more tethering elements 17E configured as an external channel through which the cable 81 may be routed or inserted to be retained by the tethering element 17E. The tethering element 17E may be formed by crimping, roll-forming, molding or otherwise configuring the material forming the band 43 to define an external channel, wherein the external channel acts to define a cable pathway 29 through which the cable 81 may be routed. The neckpiece 10B may include other configurations of tethering elements 17 which may cooperate to define a cable pathway 29. For example, the neckpiece 10B may include at least one tethering element 17D which may be configuring as a cleated tethering element 17D, including a plurality of cleats 13 arranged to retain a cable 81. The cleats 13 may be formed during forming of the band 43 by stamping, punching, molding, or otherwise to provide an integral tethering element 17D. The combination of a cleated tethering element 17D and a tethering element 17E defining an external channel is not intended to be limiting, and it is understood that other configurations of tethering elements 17 may be formed integral to the band 43 and/or operatively attached thereto to provide a neckpiece 10. For example, the band 43 may include a plurality of apertures and/or slots arranged and/or cooperating to define tethering elements 17 and a cable pathway 29 to retain a cable element 81.

Figure 9:
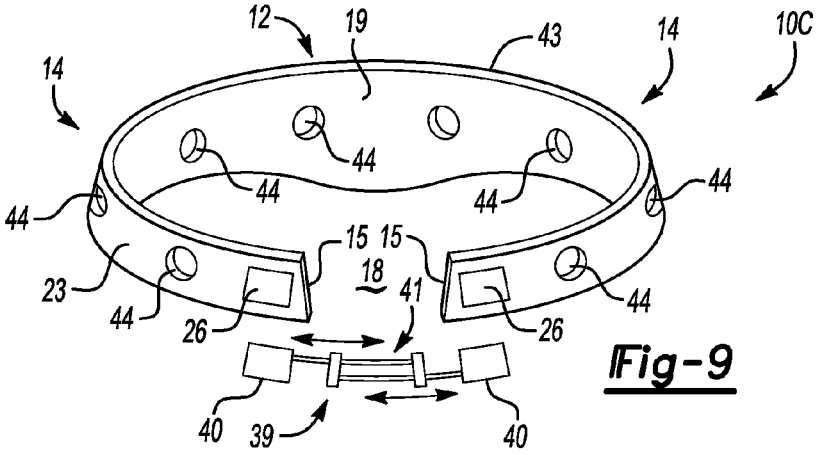
FIG. 9 is a schematic front perspective view of another example configuration of the neckpiece of FIG. 1A.
Figure 10A:
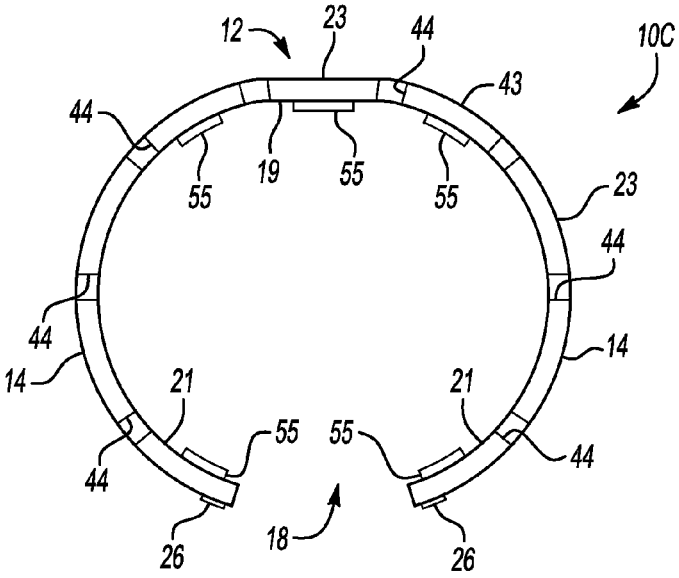
FIG. 10A is a schematic top view of an example configuration of the neckpiece of FIG. 9.
Figure 10B:
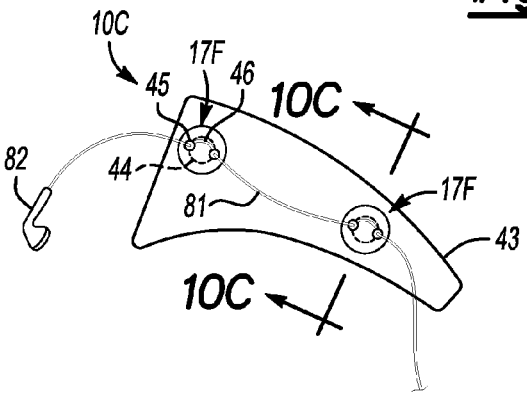
FIG. 10B is a schematic side view of the neckpiece of FIG. 9.
Figure 10C:
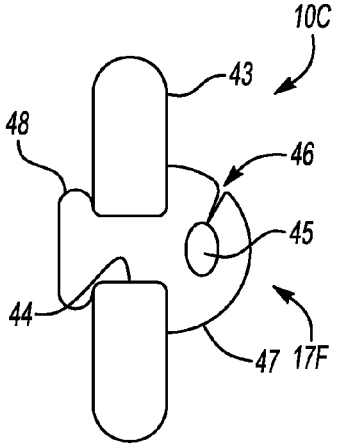
FIG. 10C is a schematic view of section 10C-10C showing the tethering element of the neckpiece of FIG. 10B.

The neckpiece 10C shown in FIGS. 9-10C includes a band 43 configured to define a plurality of apertures 44 which may cooperate to define a cable pathway 29 and/or a tethering element 17 by routing a cable 81 there through so as to retain the cable 81 to the band 43. The band 43 may be configured as a relatively narrower band as shown in FIG. 9, which may have a vertical band width (as worn by the user 70) of 20 mm or less (approximately 0.75 inches or less). In one example, the band 43 may have a vertical band width of less than 13 mm (less than approximately 0.5 inches). The band 43 may be configured as a relatively wider band as shown in FIG. 10B, which may have a vertical band width in some or all portions of the perimeter of the band 43 of 13 mm or more (more than approximately 0.5 inches), or in another example, having a vertical band width of at least 20 mm (approximately 0.75 inches or more).

The band 43 may be formed in different sizes for various size users 70, which may include providing bands 43 formed with different perimeter sizes such that a size may be selected similar to selecting a shirt by a collar size, and/or the band 43 may be provided with one or more adjustment pads 55 which a user may select and attach to the band 43 to adjust at least one of the perimeter size of the neckpiece 10C and the grasping pressure, such that a user may select and or customize a band 43 for perimeter size and/or for a relatively lighter or heavier (greater) grasping force depending on the user preference, comfort objectives, and/or anticipated activities during use, for example.

As described previously, the band 43 may be formed to define a rear interface portion 19 which may cooperate with the front interface portions 21 and/or side interface portions 20, and/or, the side interface portions 20 may cooperate, to generate a grasping pressure to retain the neckpiece 10C at a mid-neck location of a user 70. The neckpiece 10C and/or the band 43 may be configured to define living hinges 27 as described previously, to allow extension of the size of the access opening 18 during donning and doffing. The neckpiece 10C and/or band 43 may be made of a molded plastic or foam, such as a closed-cell polyurethane foam to provide a lightweight and comfortable neckpiece 10C. As described previously, the neckpiece 10C may include one or more display surfaces 23 which may display graphics including text and/or be otherwise customized, for example, with a color, texture, advertising, embellishment or other ornamental feature. The neckpiece 10C made be molded of a foam type material and incorporate graphic content on the display surface 23 such that the neckpiece 10C may be produced at a relatively low cost such that it may be provided as a promotional and/or disposable item.

The neckpiece 10C may further include one or more tethering elements 17 which may be configured for insertion into an aperture 44 and/or clipped, inserted or otherwise attached to the neckband 43. In one example, a tethering element 17F shown in FIGS. 10B and 10C, and again in FIGS. 12A and 12B, may be configured for insertion into an aperture 44 such that the tethering element 17F is removably attached to the neckband 43. The tethering element 17F may include a body 47 defining an eyelet 45 configured to receive a cable 81 through an eyelet access 46, which may be, for example, a slot extending through the body 47 into the eyelet 45. The tethering element 17F may include a retaining feature 48 to retain the tethering element 17F to the neckband 10C. In the present example, the retaining feature 48 is configured to have a cross section larger than the adjacent portion of the body 47 such that the tethering element 17F may be removably attached to the band 43 by inserting the retaining feature 48 into and partially through the aperture 44 such that the retaining feature 48 is retained on a first side of the band 43 and the portion of the body 47 including the eyelet 45 is retained on the second, e.g., opposing side of the band 43, wherein the first and second sides of the band 43 are connected via the aperture 44. The tethering element 17F may be a unitary plastic molded component manufacturable at a relatively very low cost, such that the overall cost to produce the neckpiece 10C including the tethering elements 17F may be relatively low, lending this configuration of neckpiece 10C to be usable as a promotional item and/or a disposable neckpiece 10.

Figure 11A:
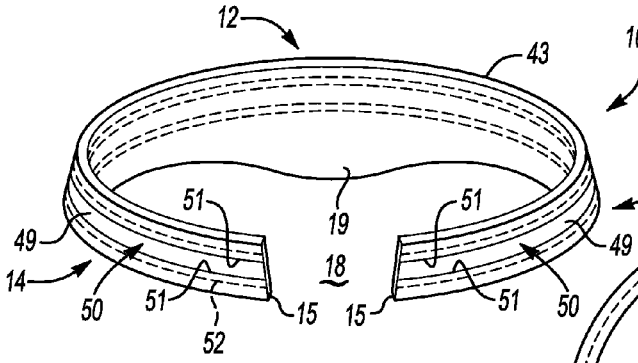
FIG. 11A is a schematic front perspective view of another example configuration of the neckpiece of FIG. 1A defining an internal channel.
Figure 11B:
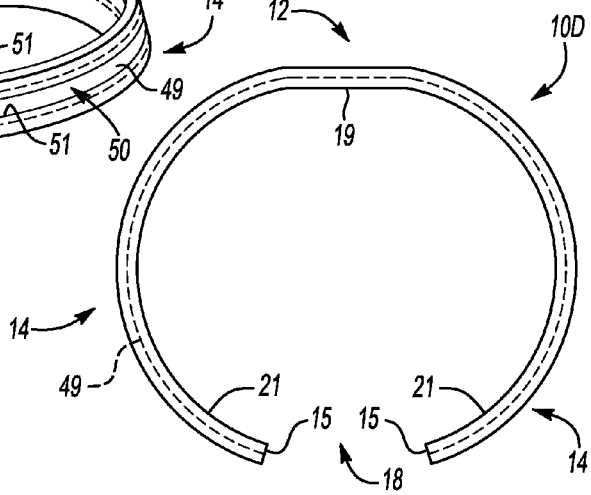
FIG. 11B is a schematic top view of an example configuration of the neckpiece of FIG. 11A.
Figure 12A:
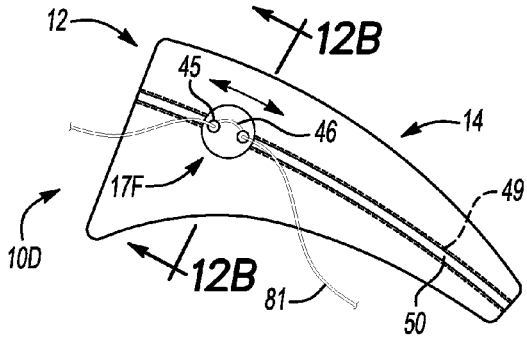
FIG. 12A is a schematic side view of an example configuration of the neckpiece of FIG. 11A including a repositionable tethering element.
Figure 12B:
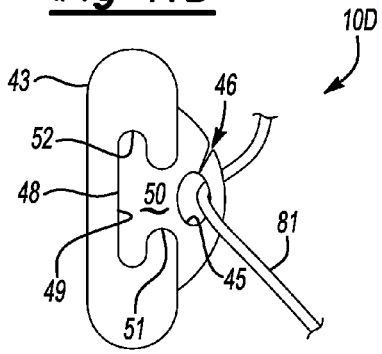
FIG. 12B is a schematic view of section 12B-12B showing the tethering element of the neckpiece of FIG. 12A.

The neckpiece 10D shown in FIGS. 11A-13B includes a band 43 configured to define a exterior channel 49, which in the example shown for neckpiece 10D is configured as an exterior channel, e.g., a channel open to an exterior surface of the band 43 including a channel opening 50 defined by the exterior surface of the band 43. The exterior channel 49 includes opposing channel lips 51 bounding the channel opening 50, and recessed portions 52 adjacent the channel lips 51. The exterior channel 49 may define a cable pathway 29 such that the exterior channel 49 may act as an integral tethering element 17 formed by the neckband 43 and configured to receive and route a cable 81 there through so as to retain the cable 81 to the band 43. The band 43 may be configured as a relatively narrower band as shown in FIG. 11A, which may have a vertical band width (as worn by the user 70) of 20 mm or less (approximately 0.75 inches or less). In one example, the band 43 may have a vertical band width of less than 13 mm (less than approximately 0.5 inches). In another example, the band 43 may be configured as a relatively wider band as shown in FIGS. 12A and 12B, which may have a vertical band width in some or all portions of the perimeter of the band 43 of 13 mm or more (more than approximately 0.5 inches), or in another example, having a vertical band width of at least 20 mm (approximately 0.75 inches or more).

As described related to neckpiece 10D, the band 43 may be formed in different sizes for various size users 70, which may include providing bands 43 formed with different perimeter sizes such that a size may be selected similar to selecting a shirt by a collar size, and/or the band 43 may be provided with one or more adjustment pads 55 which a user may select and attach to the band 43 to adjust at least one of the perimeter size of the neckpiece 10D and the grasping pressure, such that a user may select and or customize a band 43 for perimeter size and/or for a relatively lighter or heavier (greater) grasping force depending on the user preference, comfort objectives, and/or anticipated activities during use, for example.

As described previously, the band 43 may be formed to define a rear interface portion 19 which may cooperate with the front interface portions 21 and/or side interface portions 20 to generate a grasping pressure to retain the neckpiece 10D at a mid-neck location of a user 70. The neckpiece 10D and/or the band 43 may be configured to define living hinges 27 as described previously, to allow extension of the size of the access opening 18 during donning and doffing. The neckpiece 10D and/or band 43 may be made of a metal-based or nonmetallic material. Examples of the materials from which the band 43 may be made include stainless steel, carbon fiber, polymer-based materials, including reinforced polymers, composite materials, molded plastic or foam, such as a closed-cell polyurethane foam to provide a lightweight and comfortable neckpiece 10D. A channel component (not shown) forming the exterior channel 49 may be made of a first material, such as a metal or plastic molded, extruded, stamped, crimped, roll-formed or the like to form the channel component, which may then be integrated into the band 43, for example, by inserting, molding, pressing, bonding, fastening, or otherwise adhering the channel component into a receiving portion (not shown) of the neckband 43 to form a composite neckband 43. The receiving portion of the neckband 43 may be, for example, formed of plastic, foam, a textile material, or a combination of these. As described previously, the neckpiece 10D may include one or more display surfaces 23 which may display graphics including text and/or be otherwise customized, for example, with a color, texture, advertising, embellishment or other ornamental feature. The neckpiece 10D made be molded of a foam type material and incorporate graphic content on the display surface 23 such that the neckpiece 10D may be produced at a relatively low cost such that it may be provided as a promotional item.

The neckpiece 10D may further include one or more tethering elements 17F, 17G which may be configured for insertion into and to be detachably retained by the exterior channel 49. In one example, the tethering element 17F previously described related to FIG. 10C, may be inserted into the exterior channel 49 such that the retaining portion 48 of the tethering element 17F is retained in the exterior channel 49, for example, by interference of the retaining portion 48 with the channel lip 51 and/or retention of the retaining portion 48 in the channel recessed portion 52. The tethering element 17F may be repositionable in the exterior channel 49 along the perimeter of the neckpiece 10D by slidably moving the tethering element 17F along the exterior channel 49 and/or be detaching the tethering element 17F from the exterior channel 49 and reinserting or reattaching the tethering element 17F in the new location.

Figure 13A:
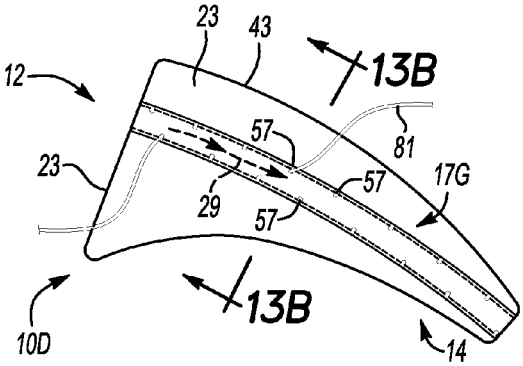
FIG. 13A is a schematic side view of an example configuration of the neckpiece of FIG. 11A including an insertable tethering element.
Figure 13B:
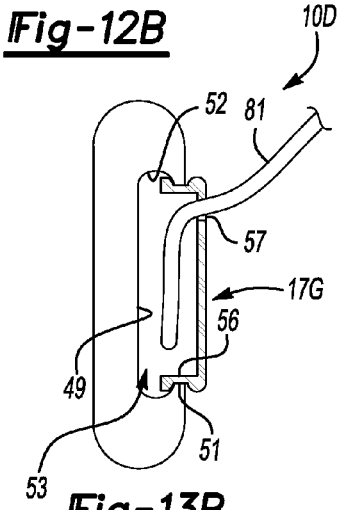
FIG. 13B is a schematic view of section 13B-13B showing the insertable tethering element of the neckpiece of FIG. 13A.

In another example shown in FIGS. 13A and 13B, a tethering element 17G may be configured to be inserted into and removably attached to the exterior channel 49. The tethering element 17G may be configured as an insertable strip or band which may include, for example, a lip interface 56 along each longitudinal edge, where the lip interface is configured to engage the channel lip 51, for example, by interference fit or through a clipping mechanism as shown in FIG. 13B, to retain the insertable strip 17G in the exterior channel 49, thereby defining a channel cavity 53 extending the perimeter length of the tethering element 17G. The tethering element 17G may include a plurality of openings 57, which may be configured as slots 57 originating in a central portion of the insertable strip (tethering element) 17G and extending through the lip interface 51 such that each of the slots 57 is accessible via the lip interface 51 for insertion of the cable 81 into the slot when the insertable strip 17G is removed from the exterior channel 49. In use and as shown in FIG. 13A, a user 70 may select a first slot 57 as an ingress slot and may insert the cable 81 into the ingress slot 57 and such that the length of the cable 81 to be retained in the cavity 53 is extended between the lip interfaces 51. The user 70 may then select a second slot 57 as an egress slot and may insert the cable 81 into the egress slot such that the remaining length of cable, for example, the length of cable terminating in an earpiece 82, extends outward from the egress slot 57 when the insertable strip 17G is inserted into and retained by the exterior channel 49. As shown in FIG. 13A, the ingress and egress slots 57 and the channel cavity 53 define a cable pathway 29 through which the cable 81 is routed and retained to the neckpiece 10D.

The neckpiece 10E shown in FIGS. 15A-15C includes a tube or tubular portion 61. The tubular portion 61 includes an interior channel 62, e.g., a channel 62 defined by an interior surface, e.g., a surface fully contained with the interior of the tubular portion 61. The interior channel 62 may be connected to the exterior surface of the tubular portion 61 via one or more openings 63, as shown in FIGS. 15A-15C. The interior channel 62 may define a cable pathway 29 such that the interior channel 62 may act as an integral tethering element 17H formed by the neckpiece 10E. The openings 63 may be selectively used as ingress and egress openings 63 through which the cable 81 is inserted and exited, to retain the cable 81 to the neckpiece 10E. The user 70 may customize the cable pathway 29 through the user's selection of a combination of openings 63 for egress and ingress openings and the cable routing elected by the user 70 to define a user customized cable pathway 29.

The tubular portion 61 may be formed of a flexible and/or elastic material such that a larger element which may be attached to a cable 81, for example, an earpiece 82 or microphone 32B, may be insertable through the openings 63 and channel 62 during routing of the cable 81 through the channel 62. The tubular portion 61 may be made of a polymeric material, and may include organic or non-organic textile to provide sufficient flexibility and elasticity to manipulate and/or insert a cable 81 through the openings 63 and channel 62. The flexibility and ergonomic shaping of the neckpiece 10E including the tubular portion 62 provide stability in locating the neckpiece 10E relative to the user's neck 71, and comfort in use.

Figure 16A:
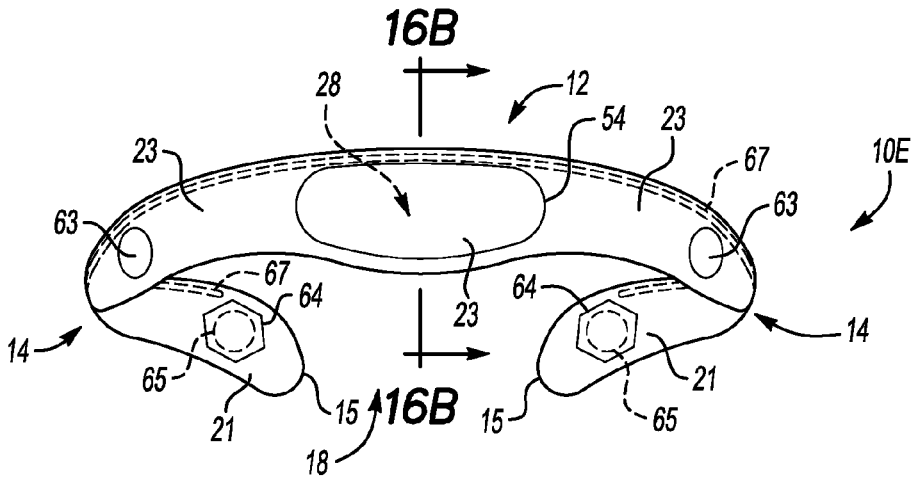
FIG. 16A is a schematic rear perspective view of an example configuration of the neckpiece of FIG. 15A including a compartment.
Figure 16B:
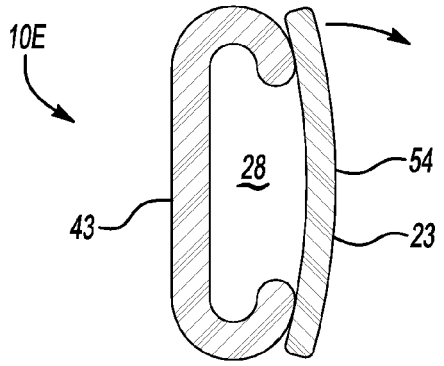
FIG. 16B is a cross-sectional view of section 16B-16B of the compartment of the neckpiece of FIG. 16A.

The neckpiece 10E and/or the tubular portion 61 may be formed in different sizes for various size users 70, which may include providing the neckpiece 10E including the tubular portion 61 in different perimeter sizes such that a size may be selected similar to selecting a shirt by a collar size which may be selectively affixed to the neckpiece 10E to adjust at least one of the perimeter size of the neckpiece 10E and the grasping pressure, such that a user may select and or customize a neckpiece 10E for perimeter size and/or for a relatively lighter or heavier (greater) grasping force depending on the user preference, comfort objectives, and/or anticipated activities during use, for example. The neckpiece 10E and/or the tubular portion 61 may be configured to include one or more tacky interfaces 64 and/or textured interfaces 65 which, as shown in FIG. 16A, may be provided as detachable pads such that the pads may be used selectively, for example, corresponding to the activity level or activity type of the user 70. The size of the detachable interfaces 64, 65 may be varied, or the interfaces 64, 65 may be customizable by the user 70 for the user's particular needs. For example, the interfaces 64, 64 may be configured to be trimmed by the user 70 to the desired size and shape prior to attachment to the neckpiece 10E. In another example (not shown), one or more of the interface portions 19, 20, 21 may be configured such that the interface portion 19, 20, 21 is configured at least partially as a tacky interface 64, for example, a silicon coated surface, and/or a textured interface 65, such that the tacky and/or textured characteristic of the interface portion 19, 20, 21 contributes to retention of the neckpiece 10 at a location on the user's neck 71. The examples provided herein are non-limiting and it would be understood that tacky and/or textured interfaces 64, 65 may be applied to and/or used with other configurations of the neckpiece 10.

The tubular portion 61 of the neckpiece 10E may be formed or configured to include a reinforcement, an insert, a less flexible portion, or other configuration which provides pre-tensioning of the neckpiece 10E and/or defines grasping interfaces such as one or more of the front interface portions 21, side interface portions 20 and the rear interface portion 19 configured to conform with the neck surface, cooperate to exert a grasping force, and/or otherwise retain the neckpiece 10E to the user's neck 71. For example, and referring to FIG. 16A, the neckpiece 10E may include an insert 67 which may be configured to provide pre-tensioning of the neckpiece 10E, and/or to exert a grasping pressure on the user's neck 71 in use. The insert 67 may be positioned in channel 62, or otherwise included in the tube portion 61, for example, by bonding the insert 67 to the tube portion 61, forming the tube portion 61 including the insert 67, inserting the insert 67 into a slot, sleeve or other recess defined by the tube portion 61 to receive the insert 67, etc. The insert 67 may be made of a metallic, non-metallic, or polymeric material, or a combination of these, and may be formed by molding, extruding, stamping, coiling, etc. For example, the insert 67 may be made of spring steel or include a spring steel element (not shown). The insert 67 may be coated, encased, sleeved or otherwise configured for user comfort and/or to facilitate installation to the neckpiece 10. In one example, the insert 67 may be generally U-shaped or C-shaped and may be formed of a polymeric or metallic material such that the insert 67 is pre-tensioned to exert a spring force as a grasping pressure on the user's neck 71 in use. The insert 67 may be flexible and/or define a living hinge 27 to facilitate donning and/or doffing the neckpiece 10E including the insert 67. The insert 67 may be provided in a coiled configuration such that the user 70 is required to expand the coiled inserted 67 for placement on the user's neck 71.

In one example, the insert 67 may be configured as a bi-stable spring, similar to a slap coil or slap bracelet, such that the insert 67 is stable in a first condition, for example, as a substantially flat strip, and may be transitioned to a second stable condition as a coiled strip. In the second condition as a coiled strip and installed in the neckpiece 10E, the bi-stable insert 67 may exert a grasping force on a user's neck 71 in use. In the first condition as a flat strip installed in the neckpiece 10E, the bi-stable insert 67 may extend or retain the neckpiece 10E in a substantially flat configuration to facilitate packaging and/or storage of the neckpiece 10E when not in use by minimizing the packaging space required for the flattened neckpiece 10E relative to the packaging space required for the coiled neckpiece 10E.

The examples of an insert 67 described herein are not intended to be limiting and it would be understood that other configurations of an insert 67 may be used in combination with configurations of a neckpiece 10 other than the configuration described for neckpiece 10E. For example, the neckpiece 10C shown in FIG. 9 may be configured to include and/or receive an insert 67.

The neckpiece 10E and/or band 43 may be made of a molded plastic or foam, such as a closed-cell polyurethane foam to provide a lightweight and comfortable neckpiece 10E, which may be molded to provide relatively stiffer or less elastic portions configured to retain the neckpiece 10E to the user's neck 71. As described previously, the neckpiece 10E may include one or more display surfaces 23 which may display graphics including text and/or be otherwise customized, for example, with a color, texture, advertising, embellishment or other ornamental feature.

The neckpiece 10E may further include one or more tethering elements 17 which may be configured for insertion into an opening 63 and/or clipped, inserted or otherwise attached to the neckpiece 10E. The neckpiece 10E may include one or more sensing elements 37, which may be in communication with a monitor 38, as described previously, where the sensing element 37 may be configured to sense one or more physiological parameters of the wearing user. The neckpiece 10E may include a compartment 28, which may be accessible to the user 70 through one of the openings 63 via the channel 62 and/or may include a detachable or accessible cover 54 which may be opened to access the compartment 28. In one configuration, the neckpiece 10E includes a relatively wider central segment 12 such that a compartment 28 defined thereby is sufficiently large volume to contain a personal user device such as a mobile phone or portable music player.

While the best modes for carrying out the invention have been described in detail, those familiar with the art to which this invention relates will recognize various alternative designs and embodiments for practicing the invention within the scope of the appended claims.

The invention claimed is:

1. A neckpiece wearable by a user, the neckpiece comprising:

opposing arm segments operatively connected to each other;

a nape interface intermediate the opposing arm segments and configured as a substantially flat surface;

a grasping interface defined by each of the arm segments;

wherein each arm segment defines a tethering element configured to removably retain a cable to the neckpiece;

wherein the arm segments are arranged such that when the neckpiece is worn by the user each grasping interface exerts a grasping pressure on the user's neck to retain the neckpiece to the user's neck in a mid-neck location; and wherein the tethering element is configured as a spiraled portion integrally formed with at least one of the arm segments.

2. The neckpiece of claim 1, further comprising:

a connecting element configured to detachably connect one arm segment from the other arm segment.

3. The neckpiece of claim 2, wherein the connecting element is a magnetic clasping element.

4. The neckpiece of claim 2, further comprising:

the connecting element including an orientation feature to orient the opposing arms relative to each other when connected by the connecting element.

5. The neckpiece of claim 1, wherein each arm segment is formed of wire.

6. The neckpiece of claim 5, wherein the wire is surface treated with one of an organic, non-organic, polymeric or metallic coating.

7. The neckpiece of claim 1, further comprising:

an access opening defined by the arm segments;

wherein the access opening is not greater than 35% of the perimeter of the neckpiece inclusive of the access opening.

8. The neckpiece of claim 1, wherein the grasping interfaces are arranged to exert the grasping pressure on one of an anterior and a lateral portion of the user's neck.

9. The neckpiece of claim 1, further comprising:

a channel at least partially defined by the arm segments;

the channel including at least one of the tethering elements configured to removably retain a cable to the neckpiece.

10. The neckpiece of claim 1, wherein:

the neckpiece is configured to receive at least one electronic element configured to be operatively attached to the neckpiece;

wherein neckpiece is configured to electrically connect the at least one electronic element to another electronic element.

11. The neckpiece of claim 1, further comprising:

a plurality of apertures defined by the neckpiece;

wherein the plurality of apertures are arranged to define a cable pathway for retaining the cable to the neckpiece.

12. The neckpiece of claim 1, further comprising:

a sensing element configured to sense a physiological parameter of the user;

wherein the sensing element is operatively attached to the neckpiece and configured such that when the neckpiece is worn by the user, the sensing element interfaces with the user to sense the physiological parameter.

13. The neckpiece of claim 1, wherein the arm segments are made of one of a polymeric material and a carbon fiber material.

14. The neckpiece of claim 1, wherein the arm segments are made of a smart material.

15. The neckpiece of claim 1, further comprising:

the opposing arm segments defining an access opening therebetween; and a clasp element configured to enclose the access opening.

16. A neckpiece wearable by a user, the neckpiece comprising:

opposing arm segments extending from a central segment and selectively connectable to each other by a connecting element configured to detachably connect the opposing arm segments;

each opposing arm segment including a tethering element defined by a spiraled portion of a wire segment configured to removably retain a cable to the neckpieces;

wherein the central segment defines a nape interface configured as a substantially flat surface;

a grasping interface defined by each of the arm segments; and wherein the arm segments are arranged such that when the neckpiece is worn by the user each grasping interface exerts a grasping pressure on the user's neck to retain the neckpiece to the user's neck in a mid-neck location.

17. The neckpiece of claim 16, further comprising:

the connecting element including an orientation feature to orient the opposing arms relative to each other when connected by the connecting element.

18. The neckpiece of claim 16, wherein the wire segment is surface treated with one of an organic, non-organic, polymeric or metallic coating.

19. The neckpiece of claim 16, further comprising:

the opposing arm segments defining an access opening therebetween; and a clasp element configured to enclose the access opening.

20. A neckpiece wearable by a user, the neckpiece comprising:

opposing arm segments integrally formed with and extending from a central segment;

wherein the central segment defines a nape interface configured as a substantially flat surface;

a grasping interface defined by each of the arm segments;

wherein the arm segments are arranged such that when the neckpiece is worn by the user each grasping interface exerts a grasping pressure on the user's neck to retain the neckpiece to the user's neck in a mid-neck location;

a channel defined by a spiraled portion of at least one of the central segment and the arm segments;

wherein the channel is configured to at least partially define a cable pathway for retaining a cable to the neckpiece; and wherein the spiraled portion is integrally formed with the at least one of the central segment and the arm segments.

* * * * *

UNITED STATES PATENT AND TRADEMARK OFFICE

CERTIFICATE OF CORRECTION

PATENT NO. : 9,055,795 B2
APPLICATION NO. : 13/852763
DATED : June 16, 2015
INVENTOR(S) : Nicholas Stuart Larkin It is certified that error appears in the above-identified patent and that said Letters Patent is hereby corrected as shown below:

Claims

Column 23, line 32, Claim 16 should be changed from "ured to removably retain a cable to the neckpieces;" to "ured to removably retain a cable to the neckpiece;"

Signed and Sealed this
Tenth Day of November, 2015

Michelle K. Lee

Michelle K. Lee
*Director of the United States Patent and Trademark Office*